US006957621B1

(12) United States Patent
Halman

(10) Patent No.: US 6,957,621 B1
(45) Date of Patent: Oct. 25, 2005

(54) GUIDE FOR ASSISTING SAILS OVER STANCHIONS

(76) Inventor: Mark J. Halman, 44 Wilding La., Oakland, CA (US) 94618

( * ) Notice: Subject to any disclaimer, the term of this patent is extended or adjusted under 35 U.S.C. 154(b) by 0 days.

(21) Appl. No.: 10/840,991

(22) Filed: May 7, 2004

(51) Int. Cl.[7] ..... B63H 9/04
(52) U.S. Cl. ..... 114/102.1; 114/364
(58) Field of Search ..... 114/102.1, 102.12, 114/102.16, 102.18, 102.19, 102.2, 102.21, 114/104, 111, 113, 114, 115, 364

(56) References Cited

U.S. PATENT DOCUMENTS

| | | | | |
|---|---|---|---|---|
| 3,318,277 A | * | 5/1967 | Palm | 114/102.1 |
| 3,477,402 A | * | 11/1969 | Compte | 114/89 |
| 4,206,716 A | * | 6/1980 | Anderson | 114/102.1 |
| 4,473,024 A | * | 9/1984 | Armstrong | 114/111 |
| 4,561,373 A | * | 12/1985 | Hackney | 114/89 |

OTHER PUBLICATIONS

Mark J. Halman, "Declaration with Respect to Prior Art," attached Exhibit A, total of 2 pages.
Ronstan, "Stanchion & Life Line Hardware," PNP209R and PNP209RN, Ronstan, p. 80, at least as early as Nov. 14, 2003.
Accessories, Sail Chafe Protectors, p. 80, at least as early as Nov. 14, 2003.
Declaration of Mark Halman, Executed on Feb. 17, 2005 and attached Exhibit's A-C.

* cited by examiner

*Primary Examiner*—Andrew D. Wright
(74) *Attorney, Agent, or Firm*—Charles R. Cypher

(57) ABSTRACT

A stanchion attached to a sail boat is provided where the stanchion supports a lifeline near the top of the stanchion and the lifeline runs generally along the outer edge of the deck of the sail boat and the connection of the lifeline to the stanchion can be characterized in part by the maximum deflection point of the lifeline and the stanchion has attached thereto a generally vertically disposed slide disposed away from the central plane of the sail boat. The outer slide surface of the slide is characterized by a profile and the limit of the edge of the profile falls between a circular arc which begins near the top of the stanchion, has the maximum deflection point of the lifeline as its center, and travels away from the central plane of the sail boat and downwardly toward the deck of the sail boat and a curve which begins near the top of the stanchion, has at least one point that is on a level below the top of the stanchion, and moves progressively farther away from the maximum deflection point of the lifeline as it travels away from the top of the stanchion.

20 Claims, 18 Drawing Sheets

GUIDE FOR ASSISTING SAILS OVER STANCHIONS

BACKGROUND OF INVENTION

The present invention relates to a device for preventing sail chafe on lifelines and, more specifically, for aiding sailors in skirting a head sail over the stanchions and lifelines of a boat when the head sail is blown outside of the lifelines of the boat and the sailors desire to trim the sail so that it lies within the lifelines of the boat or to a position above the deck of the vessel.

Sailboats are often fitted with lifelines to prevent sailors falling overboard.

Sailboats up to 30 feet are usually fitted with one lifeline at 18 inches above the deck, and sailboats larger then 30 feet are often fitted with a pair of lifelines. The lifelines are made from wire. The wire lifelines may be coated with plastic or fitted with sleeves (also of plastic) to protect the sails and users from the rough surfaces of the wires.

In sailboats of longer than 30 feet, the pair of wires are generally set about 12 inches and 24 inches above the level of the deck. The wires are typically supported every 7 feet by vertical tubes called stanchions. These tubes are typically made from metal. The top height of the stanchion typically corresponds to the height of the upper of the two lifelines.

While these lifelines are important for the safety of the sailors, helping to prevent them from falling overboard, especially in rough seas, they can interfere with the trimming of the sails.

Sail trim is a vital component to sailing efficiency. If the sails of a boat are not properly trimmed the boat will move slowly. Sail trim is especially important in racing. If sails continuously flap (flag) or abrade on something they will wear out quickly.

The placement of the lifelines and stanchions on a typical sailboat are particularly troublesome for trimming of the fore sail or head sail after a tacking maneuver. Types of fore sail or head sails include jibs and genoas, with most sail boats commonly being sailed with a jib as well as the main sail, when going up wind.

The jib is positioned in front of the mast on a typical sailboat. The jib is a triangular sail with three points of trim. The top apex of the triangular sail is called the head. The forward corner of the sail is called the tack. The rearward tip of the sail is called the clew. The sail is rigged on a stay that runs from a tack fitting at the bow of the boat to the top of the mast. This stay is typically called the fore stay. Both the tack fitting at the bow of the boat and the top of the mast typically lie on the center plane of the boat.

The stay is typically a wire or rod. The jib is rigged by attaching a halyard to the head of the sail, attaching the front edge of the sail or luff to the stay by a clip that will allow the front edge of the sail or luff to run up and down on the stay and pulling on the halyard which is run over the top of the mast on a pulley.

The tack of the sail is attached to the stay and the jib tack fitting at the bow of the boat. Typically, the tack of the sail will be attached to the stay very close to the deck of the boat. This elevation is preferably well below the top lifeline of the boat.

The luff of the sail generally corresponds to the line defined by the stay. Depending on the length of the luff, the head sail can reach to the top of the mast or at a point on the stay below the top of the mast. Depending on the particular rigging of the boat, the head sail and the head sail stay can be specially fitted to actually hold the luff of the head sail along its entire length or at various points along its entire length.

The rest of the trim of the sail is controlled by putting tension on the sail at the clew so that the clew of the sail is pulled toward the center plane and the stern of the boat.

When a sailboat tacks (the boat is turned towards the wind until the wind comes from the opposite side of the vessel), the head sail or jib has to be moved from one side of the boat to the other. The head sail or jib has to be moved from the leeward side of the boat to the other side of the boat.

However, in certain boats, because of space limitations and the size of the head sail or jib, moving the jib from one side of the boat to the other can be a difficult maneuver to accomplish quickly.

It is common for the foot or bottom of the head sail or jib to be very long. Typically, head sails with longer foot or bottom have more power, thus they are desirable, even if their length can make them more difficult to trim.

It is also typical for the foot or bottom of the head sail to be so long that when the sail is fully sheeted-in for proper trim given the wind conditions the foot of the sail runs past an upstanding structure of the boat, such as the mast. Such head sails are often referred to as overlapping head sails. During the turning of the boat, the mast or other upstanding structure can interfere with the ability of the head sail or jib to be moved from one side of the boat to the other.

During a tack, to get around the upstanding structure, such as the mast, the tension on the clew or back tip of the head sail that allowed the head sail to capture the wind is released. This allows the back or clew of the sail to be blown and/or pulled forward towards the bow of the boat and around the forward side of the mast or other upstanding structure.

However, once the clew of the sail clears the upstanding structure or mast of the boat, the clew of the sail will want to be blown directly downwind and over the leeward side of the boat and over and outside of the lifelines of the boat.

Once the clew of the head sail clears the mast or other upstanding structure of the boat, the sailors on the boat, ideally, try to reapply tension to and to pull the clew of the sail as quickly as possible towards the stern to once again capture wind in the sail and accelerate more quickly.

It is to be noted that typically the tension on the head sail is controlled by a rope or sheet attached to the clew or back corner of the sail, and this line or sheet is controlled by a sailor near the stern of the boat, so that even if the jib or head sail does not run past the mast the line or sheet controlling it does.

To control and get power in the head sail as quickly as possible, typically the clew of the head sail is connected to two jib sheets, each sheet passing around a different side of the mast of the boat.

Thus to accomplish a tacking operation in a typical sailboat, tension on the first jib sheet on the original (leeward) side is released, the clew or back corner of the head sail is allowed to be blown around the front of the mast or other upstanding structure, and then as quickly as possible, the second jib sheet on the other side (the new leeward side) is pulled toward the sailor and the stern of the boat to reapply tension to the clew of the head sail and capture wind in the head sail.

Sailboats are typically fitted with blocks, winches and cleats to aid the sailor in sheeting in and holding the jib at a certain orientation with respect to the wind. The jib sheet winches and cleats are typically located aft of the mast near the cockpit in the stern of the boat. Often the location of other halyards, sheets and lines for other parts of the rigging of the boat will mean these winches and cleats for the head sail are best set away from the center plane of the boat to make best use of the limited space on the boat for all the rigging needs of the boat.

Each of the sheets attached to the clew of the head sail are also typically run through a block attached to the deck of the boat. This block is generally mounted on a track that allows it to be positioned at different locations along the length of the hull, depending on the expected types of sailing that will occur, and is called a car, because it is moveable. This track for the pulley is typically mounted close to the outside edge of the boat on deck of the boat. This car on its track is typically called a jib-car.

The blocks for the clew of the head sail are also typically mounted aft of the mast and often are also mounted aft of at least two of the stanchions supporting the lifelines.

Thus, on a typical boat with typical lifelines that rise as high as 24" above the deck of the boat, the sheet lines that provide the only directional control of the clew of the head sail can be mounted close to 24" below the level of the top lifeline and could be lower if the deck is sunken at that point where the block attaches to the deck of the boat.

The winches are helpful in sheeting the head sail when it begins to capture the wind as they allow the sailor to expend less energy in tensioning the large sails. In fact, in some cases the strength of the wind is too great for the sailor to fully sheet-in the sail during some maneuvers without the aid of the pulley and winches. Sometimes winches can also help the sailor to sheet the head sail in more quickly than he could otherwise.

During a properly executed tack, once the clew of the head sail clears the forward portion of the mast, it is usually important to sheet-in the head sail on the new side of the mast as quickly as possible to stop the head sail from flagging and assist the boat in finishing the tacking maneuver and accelerating as quickly as possible.

However, even if the sheet is pulled in quickly, the wind may blow the clew and much of the foot of head sail outside the lifelines of the boat so that the bottom or foot of the jib is outside of (and below the level of) the lifelines.

As noted earlier, the tack of the sail is attached to the rigging at a point below the lifelines at the bow of the boat. So if the clew of the sail along with other portions of the foot of the sail are blown outside and over the lifelines of the boat, the forward portion of the foot of the sale will be pulled up and over the lifelines. The action on the aft portion of the foot of the head sail is somewhat similar. The sheet that controls the clew of the head sail runs through a block or car that is also well below the top lifeline of the boat, so if the clew of the sail along with other portions of the foot of the sail are blown outside and over the lifelines of the boat the sheet will be pulled up and over the lifelines. However, even though the tack of the sail is anchored below the lifelines and on the inside of the lifelines at or near the deck, and the sheet attached to the clew is also being pulled from a point at a block that is below the lifelines and on the inside of the lifelines at or near the deck, and even though both the forward portion of the foot of the head sail and the sheet had to be pulled up and over the lifelines, the shape of the sail allows it to fill with air when there is wind such that it resists being pulled in towards the boat by the sheet, but more importantly, the shape and rigging of the sail also allows the foot of the sail to drop outside and below the top level of the lifelines.

Then as the head sail is sheeted in, the sail starts to approach the lifelines of the boat and to be stretched along the outside of the life lines.

Also, because the tack and the sheet are located at the level of the deck and below the top of the lifelines, the foot of the sail is pulled downward as it is sheeted-in. This causes the foot of the sail to push down on the lifelines, and to the extent that there is slack on the lifelines the lifelines where the sail comes over them is pushed down as well.

Eventually, as the sailor continues to trim the sail by sheeting-in, the sailor will reach a point in the process where one or more of the tops of stanchions depending on where the foot of the sale fell outside of the stanchions will be rubbing against the material of the sail, and most of the foot of the sail will be under tension with the sail pushing down on the lifelines at two points, and the foot of the sail is below the tops of one or more of the stanchions, and the sailor risks puncturing the sail with the tops of one or more of the stanchions if she sheets in any further.

At this point, usually, the trimming, the tensioning of the sheet attached to the clew of the sail, has to be stopped midway while the foot of the jib is manually pulled up and over the lifelines and the stanchion. This manual task is often referred to as "skirting the jib". Then the trimming can be finished.

Several devices are sold that help reduce the possibility of tearing the sail on the stanchions due to problems with trimming the head sail.

In certain instances, some of devices probably do help the jib up and over the stanchion, but none is able to achieve the results of this invention.

Devices typically called "sail chafe protectors" such as those sold in the Harken Catalogue, part number 285, and Ronstan Catalogue, part number PNP209, are designed to act as rollers to reduce friction as the foot of the jib is pulled up and over the top lifeline and tops of the stanchions. These devices are wheels that are attached to the lifelines and can rotate around the lifeline. Stops are typically placed on the lifelines near the stanchions to keep these rollers near the stanchions where they can help the sail over the stanchion. However, the foot of the head sail can still be trapped on the outside of the lifelines with these devices in certain situations such that the sail cannot be skirted over the lifelines except by manually lifting the foot of the sail over the lifelines by grabbing and lifting the foot of the sail near the center of the sail.

The inventor has also seen sailors attach hard spheres, such as hollow hand-sized plastic balls to the stanchions, near or at the tops of the stanchions, to help prevent the sail from being torn by the tops of the stanchions when the sail is sheeted in too tightly when portions of the foot of the sail have been blown over the lifelines. However, the foot of the head sail can still be trapped on the outside of the lifelines with these devices and need manual lifting, since these devices have not been optimized for the particular configuration of the lifelines, stanchions, sail and its rigging.

Another common setup and method is to have the lifelines as tight as possible so they don't sag, so that only a small portion of the foot of the sail is trapped on the outside of the lifelines and then to strike downward on the top lifeline where it comes in reach of the sailor in the cockpit in an attempt to cause a wave in the lifeline that will throw the jib over the tops of one or more of the stanchions. This approach is by no means guaranteed to work in all situations.

SUMMARY OF THE INVENTION

It is an object of the invention to provide a device that enables a sailboat head sail to avoid being snagged or caught on the stanchions of the boat, when the head sail is being trimmed from a position outside of the lifelines and stanchions to a position above the deck of the vessel.

It is a further object of the invention to provide a device that enables a sailboat head sail to avoid being snagged or caught on the stanchions of the boat, when the head sail is being trimmed from a position outside of the lifelines and stanchions to a position above the deck of the vessel, and the trimming of the sale occurs solely by tightening of the jib sheet.

These objects of the invention are achieved in part due to the shape of the device.

When the jib is being trimmed from a position outside of the lifelines and stanchions, the device is shaped to require the foot of the jib to rise up and over the stanchions as the jib sheet is tightened.

These objections of the invention are achieved in part, because the location and the shape of the devices prevents the jib from entering a space or adopting a configuration where it can be trapped outside of the lifelines with portions of the sail in contact with the tops of the stanchions such that it could not be pulled back over the lifelines merely by sheeting in.

These objects are also achieved in part due to the location of the device on the stanchions of the boat.

The present invention prevents any part of the jib occupying the area bounded by the present invention.

Thus according to the present invention, when the jib is blown outside of the lifelines, when the jib is sheeted in, the jib will be able to rise up and over the lifelines and stanchions without being caught on the stanchions.

According to the present invention, a stanchion attached to a sail boat is provided where the stanchion supports a lifeline near the top of the stanchion and the lifeline runs generally along the outer edge of the deck of the sail boat and the connection of the lifeline to the stanchion can be characterized in part by the maximum deflection point of the lifeline and the stanchion has attached thereto a generally vertically disposed slide disposed away from the central plane of the sail boat. The outer slide surface of the slide is characterized by a profile and the limit of the edge of the profile falls between a circular arc which begins near the top of the stanchion, has the maximum deflection point of the lifeline as its center, and travels away from the central plane of the sail boat and downwardly toward the deck of the sail boat, so long as the arc is disposed above a lateral limit of the outer slide surface, the lateral limit being a point with respect to the slide below which the sail cannot reach, and a curve which begins near the top of the stanchion and moves progressively farther away from the maximum deflection point of the lifeline as it travels away from the top of the stanchion, so long as the curve is disposed above a lateral limit of the outer slide surface, the lateral limit being a point with respect to the slide below which the sail cannot reach.

DETAILED DESCRIPTION OF THE PREFERRED EMBODIMENT

Figure 7:
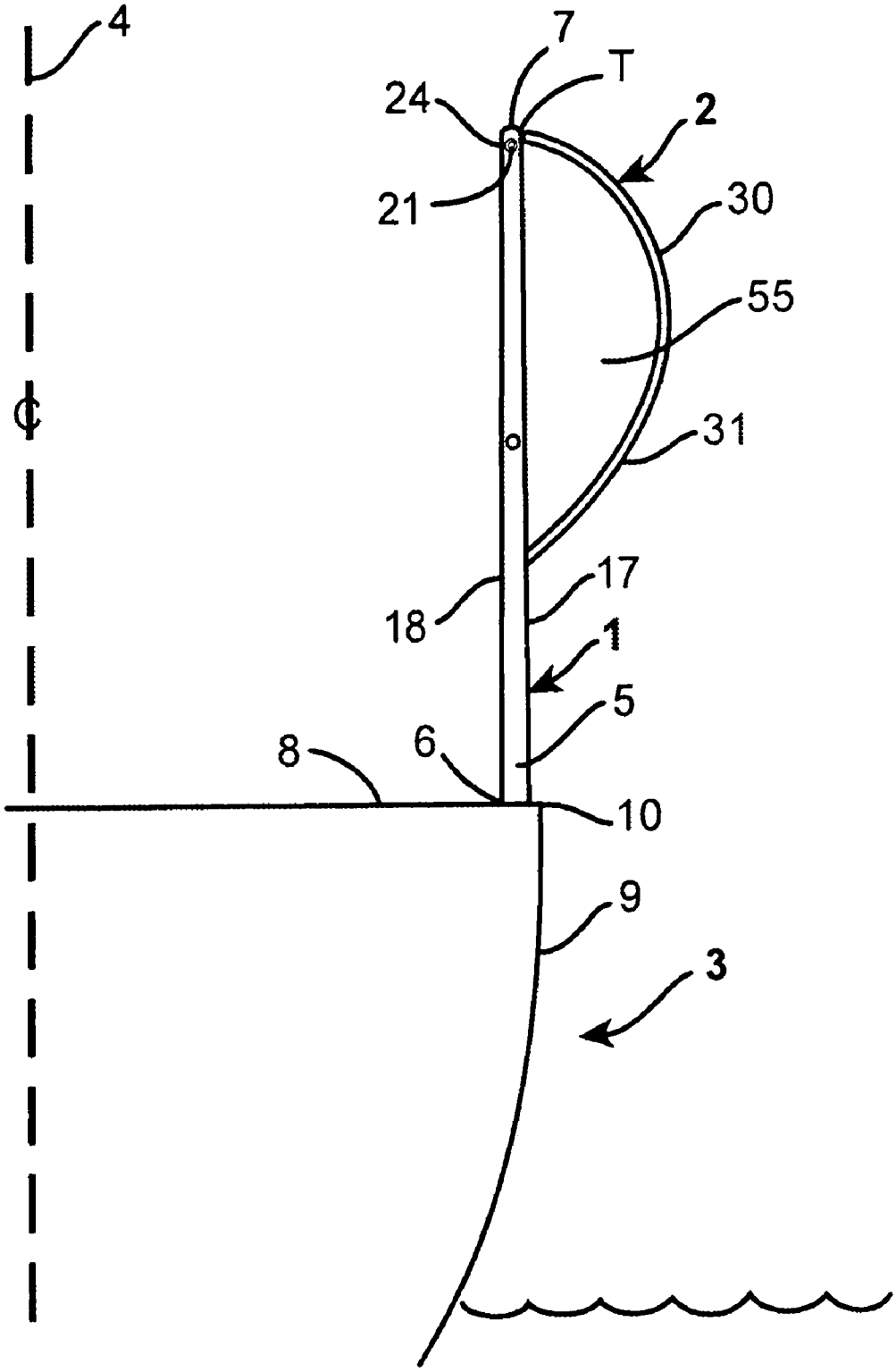
FIG. 7 is an end view of a stanchion formed according to the present invention attached to a boat.
Figure 8:
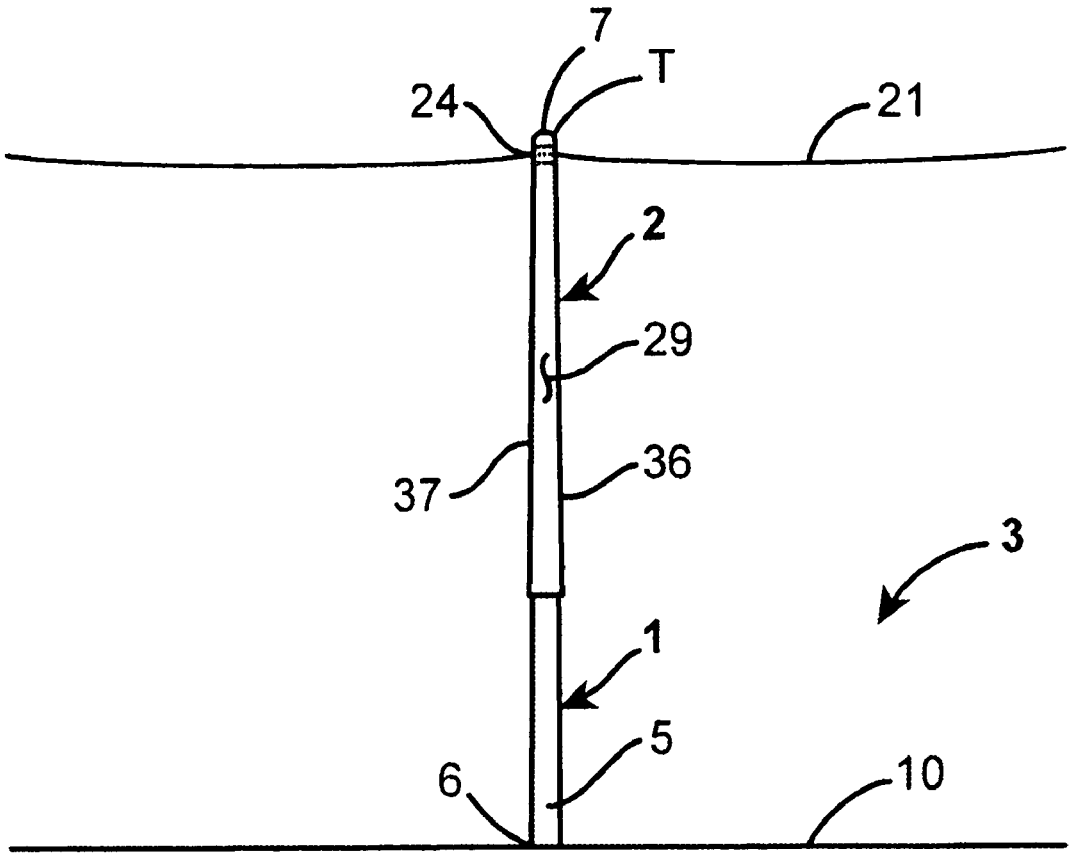
FIG. 8 is a side view of the stanchion of FIG. 7, formed according to the present invention attached to a boat.

As shown in FIG. 7, the present invention consists of a stanchion 1 having a slide 2 that is attached to or is formed as part of the stanchion 1 of a sail boat 3 on the side of the stanchion 1 away from the central plane 4 of the said boat 3.

Figure 4:
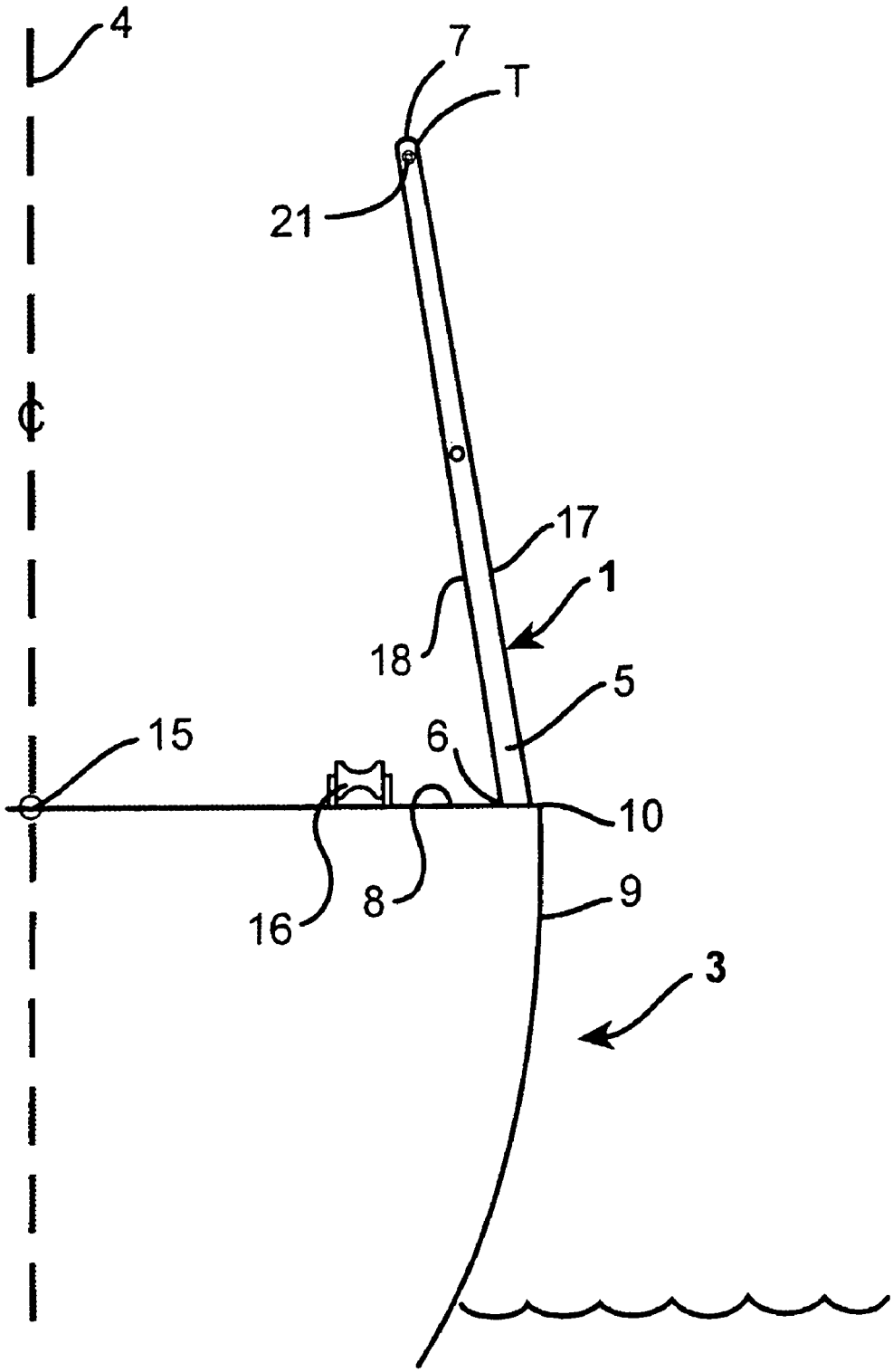
FIG. 4 is an end cross-sectional view of the boat and a stanchion attached to the deck of a boat from the rear of the boat. The stanchion shown is bent inwardly toward the centerline of the boat.

As is also shown in FIG. 4, the stanchion 1 is a generally vertically disposed post 5, having a base 6 and a top 7, the base 6 of the stanchion being attached to the sail boat 3.

Figure 1:
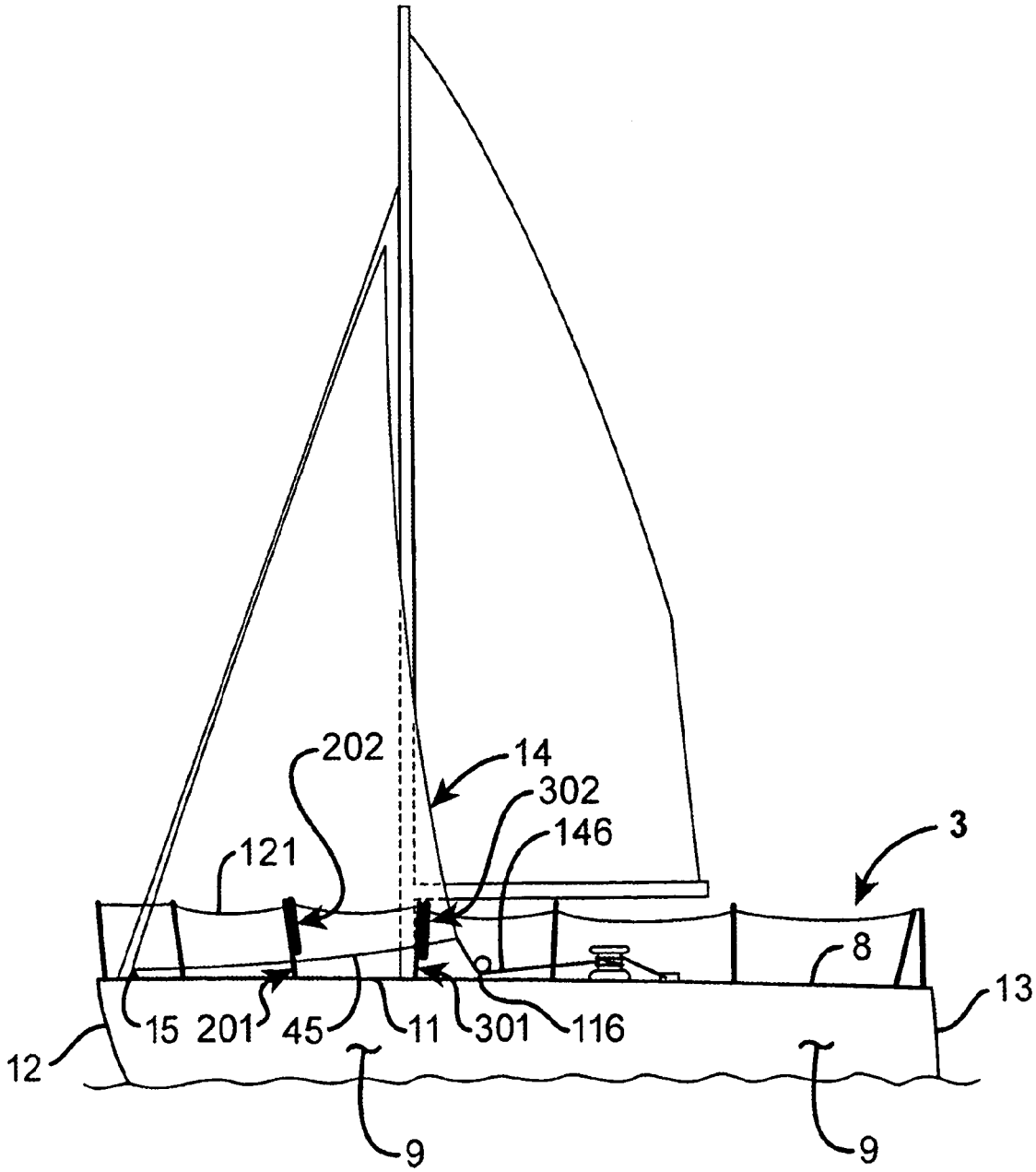
FIG. 1 is a simplified side view of a sail boat, showing the simplified rigging for a head sail or jib, the mast of the boat, and stanchions having structures of the present invention attached thereto. The jib or head sail is shown as it would look if trimmed within the lifelines of the boat.
Figure 2:
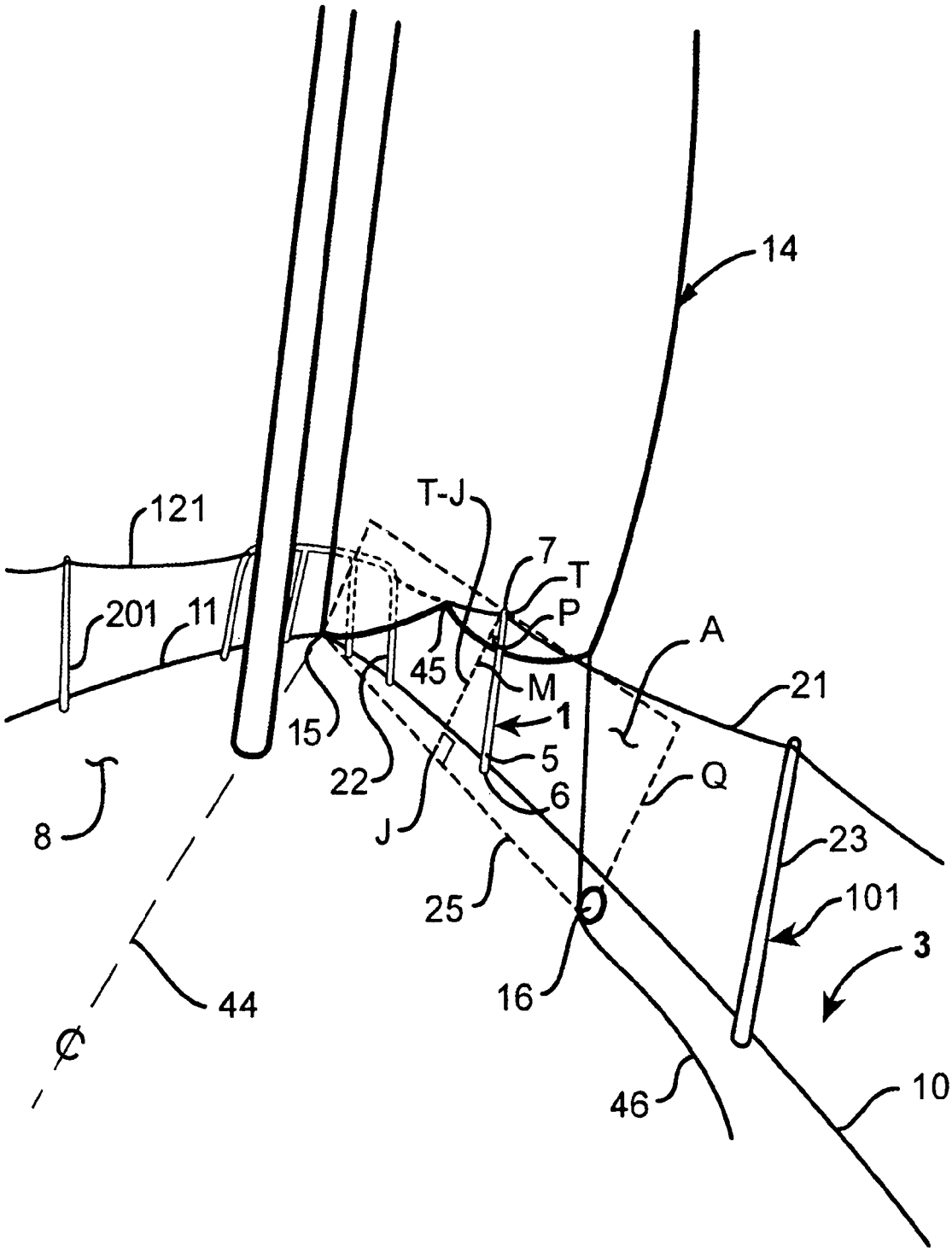
FIG. 2 is a simplified perspective view of a portion of a sail boat showing the bow of the boat, taken from a point in the cockpit near the stern of the boat. This view shows the simplified rigging for the lower portion of a head sail or jib. The stanchions shown do not have the present invention attached to them. The jib is shown as it would look if it had been blown outside of the lifelines and then trimmed to a point where it was caught on one of the stanchions of the boat.

As is shown in FIGS. 2 and 4, the sail boat 3 has a deck 8 and a hull 9 and the deck 8 and the hull 9 meet at the outer edges 10 and 11 of the deck 8, and the stanchion 1 is disposed near an outer edge 10 or 11 of the deck 8. As is shown in FIG. 1, the sail boat 3 also has a bow 12 and a stern 13 and is characterized by the central plane 4 that runs from the bow 12 to the stern 13.

As is shown in FIG. 2, the sail boat 3 also has at least one sail 14 having points of trim at what the inventor has termed the jib-tack fitting 15 near the bow 12 and a jib block 16 disposed away from the bow 12 and towards the stern 13. Note the boat 3 is equipped with a second jib-block 116 on the opposite side of the boat 3.

While the inventor has called these fittings the jib-tack fitting 15 and the jib block 16 for ease of understanding of the invention, since the jib sail is a typical sail 14 which will benefit from the invention, the invention should in no way be construed as only working with sails 14 called jibs.

Figure 11:
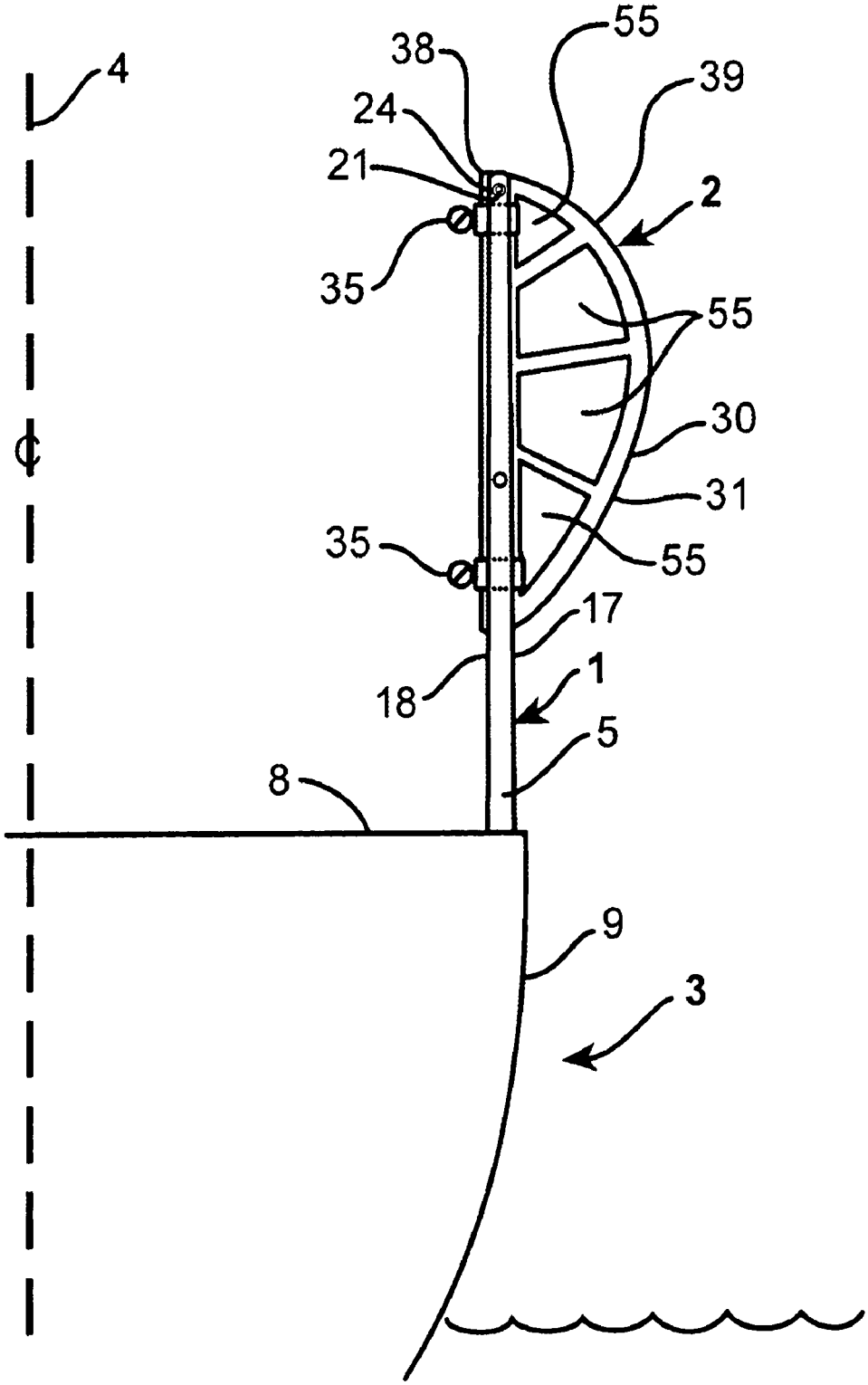
FIG. 11 is an end view of a stanchion having a structure formed according to the present invention attached thereto.
Figure 12:
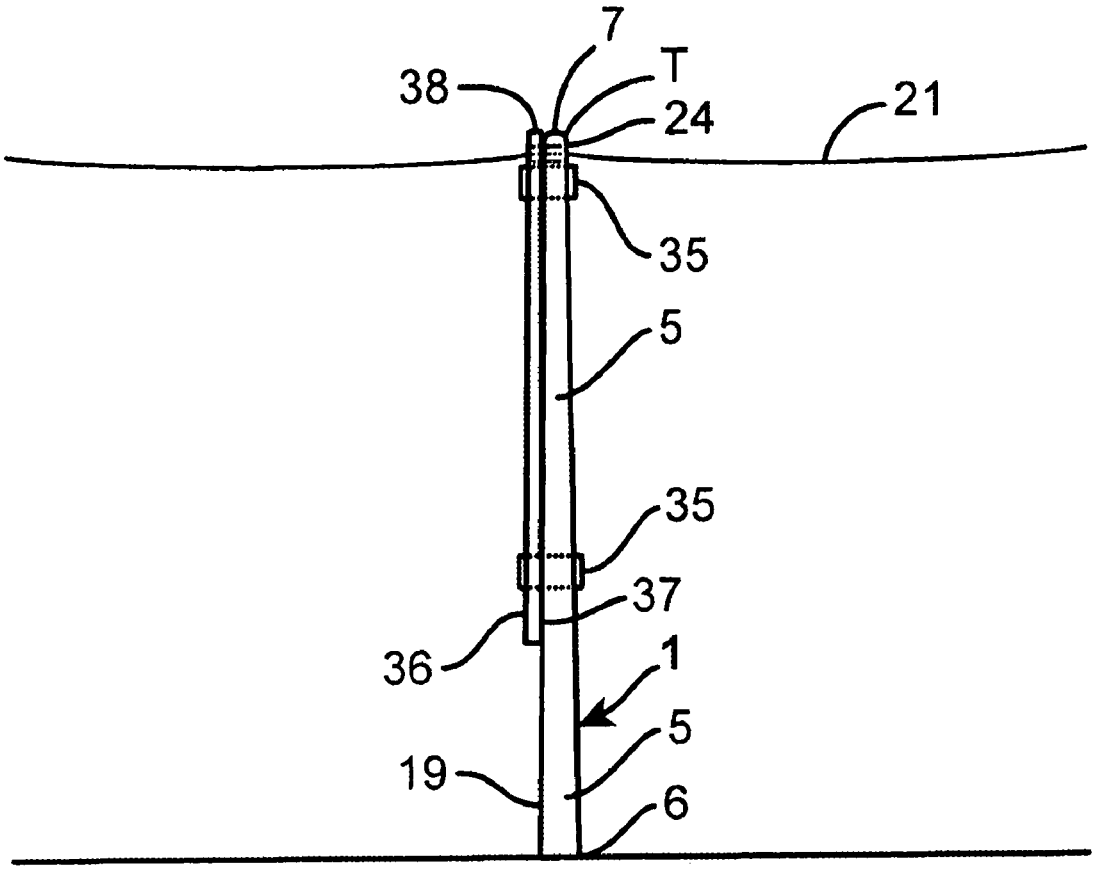
FIG. 12 is a side view of the present invention of FIG. 11, formed according to the present invention attached to a boat.

As shown in FIGS. 11 and 12, the stanchion 1, as described above, consists of a post 5 also having an outer surface 17 disposed away from the central plane 4 of the sail boat 3, and an inner surface 18 disposed towards the central plane 4 of the sail boat 3 and a bow side limit 19 and a stern side limit 20. The bow side limit 19 of the stanchion 1 is the furthest point on the stanchion 1 towards the bow 12, and the stern side limit 20 is the furthest point on the stanchion 1 towards the stern 13.

Figure 15:
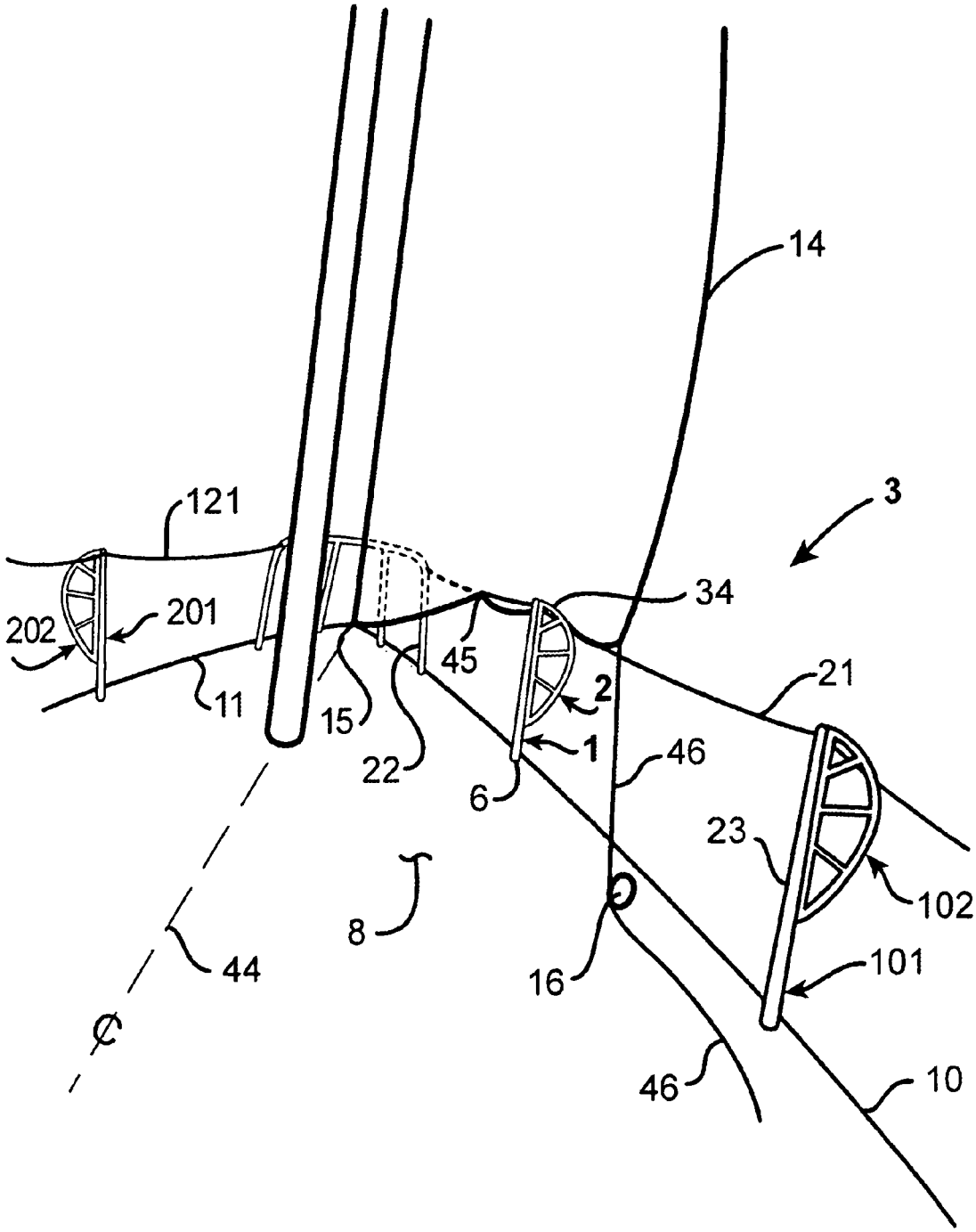
FIG. 15 is a simplified perspective view of a sail boat showing the bow of the boat, taken from a point in the cockpit of the stern of the boat. This view shows the simplified rigging for the lower portion of a head sail or jib. The stanchions shown have the present invention attached to them. The jib is shown as it would look if it had been blown outside of the lifelines and is in the process of being trimmed from a location just outside the lifelines where the present invention can act on it and prevent it from being caught on a stanchion.

As shown in FIGS. 1 and 15, the present invention can be used on a number of stanchions 1 and 101, 201, and 301 on the boat 3 as will be described more fully below, but for purposes of defining the invention each stanchion 1 is treated separately with respect to the jib-tack fitting 15 and the jib block 16 or 116.

As shown in FIG. 15, in the present invention, the selected stanchion 1 is characterized with respect to jib block 16 on the same side of the central plane 4 of the sail boat 3 as the jib block 16. As shown in FIG. 1, stanchions 201 and 301 would be characterized with respect to jib block 116.

As shown in FIG. 15, with respect to stanchion 1, the jib block 16 is closer to the stern 13 of the sail boat 3 than the stanchion 1 and the stanchion 1 is closer to the stern 13 of the sail boat 3 than the jib-tack fitting 15.

As shown in FIG. 15, stanchion 1 of the present invention supports a lifeline 21 near the top 7 of the stanchion 1. The lifeline 21 runs generally along the outer edge 10 or 11 of the deck 8 to which the stanchion 1 is connected, and the lifeline 21 is supported by a bow side member 22 disposed a selected distance away from the bow side limit 19 of the stanchion 1, and the lifeline 21 is also supported by a stern side member 23 disposed a selected distance away from the stern side limit 20 of the stanchion 1. The lifeline 21 generally is threaded through a passage 24 in the stanchion 1.

Figure 16:
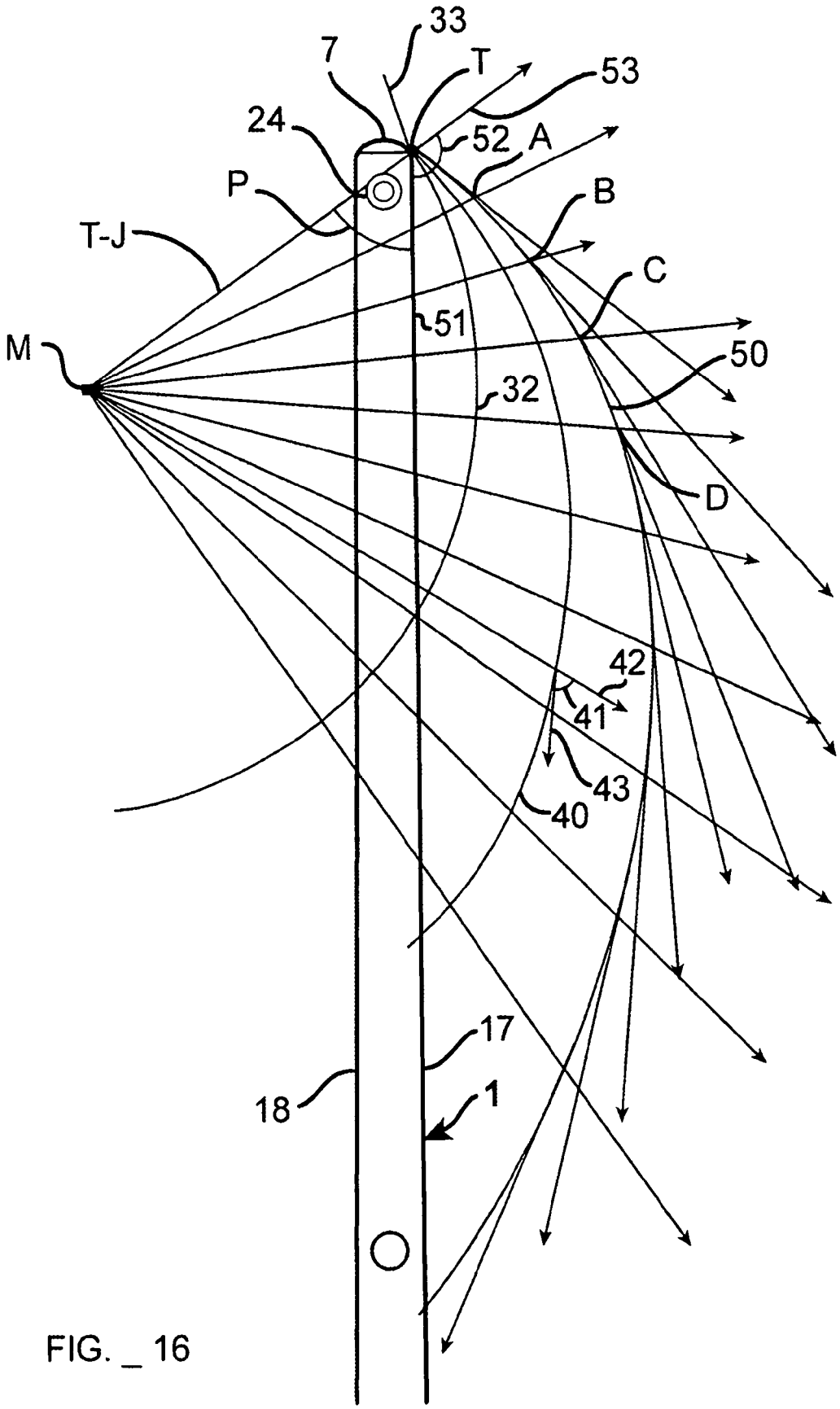
FIG. 16 is a representation of a stanchion in end view. A typical upstanding, straight stanchion is shown.

As shown in FIG. 16, the connection of the lifeline 21 to the stanchion 1 can be characterized in part by a maximum deflection point M of the lifeline 21. The maximum deflection point M of the lifeline 21 describes the amount of displacement that can be imposed on the lifeline 21 with respect to a selected line segment T-J (See FIG. 2).

As show in FIG. 2, the selected line segment T-J goes from a point T located approximately at the top 7 of the stanchion 1 to the approximate intersection point J of the line segment T-J with the jib trim line 25. The jib trim line 25 is a line running from the jib-tack fitting 15 to the jib block 16. The selected intersection point J is the place where the line segment T-J meets the jib trim line 25 at a right angle.

Figure 17:
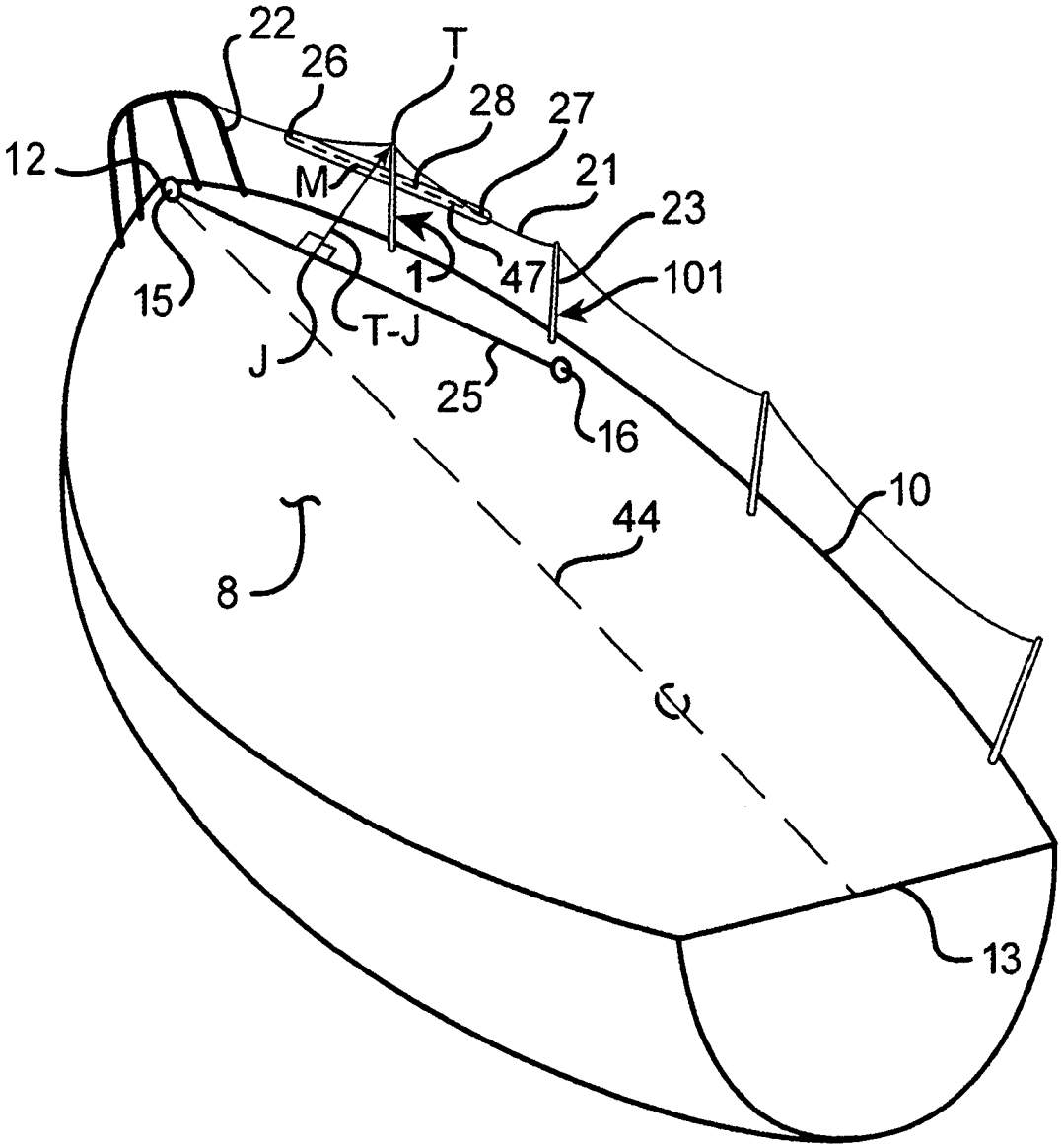
FIG. 17 is a simplified perspective view of the hull of a sail boat. Stanchions and lifelines are shown on one side of the hull.
Figure 18:
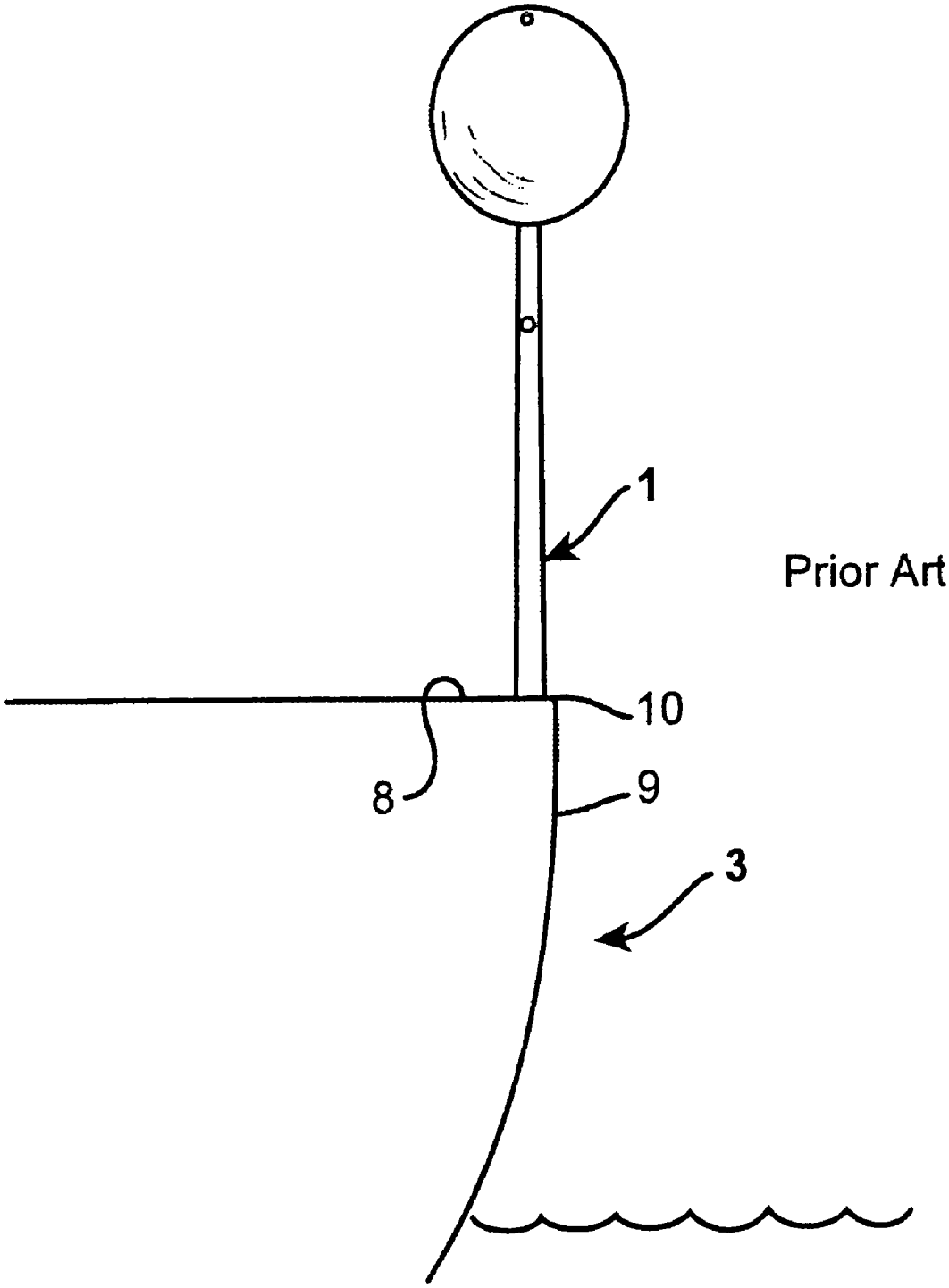
FIG. 18 is a cross-sectional end view of a stanchion showing a prior art device. The device shown is a sphere attached to the stanchion.

As shown in FIG. 17, the displacement of the lifeline 21 occurs at first and second points 26 and 27 on the lifeline 21, the first point 26 on the lifeline 21 being approximately midway between the bow side member 22 and the stanchion 1 and the second point 27 on the lifeline 21 being approximately midway between the stern side member 23 and the stanchion 1.

As shown in FIG. 17, the displacement occurs by pulling the lifeline 21 toward the central plane 4 and the center line 44 of the sail boat 3 in a direction along the line segment T-J or by pushing on the lifeline 21 toward the central plane 4 of the sail boat 3 in a direction along the line segment T-J. The displacement occurs specifically by pulling or pushing the lifeline 21 at the first and second points 26 and 27 in the direction of the line segment T-J and towards the central plane 4 of the sail boat 3 until the stanchion 1 is close to deforming under the tension force exerted by the lifeline 21 and determining where a line 28 drawn from the first and second points 26 and 27 on the lifeline 21 would intersect with the line segment T-J.

Figure 13:
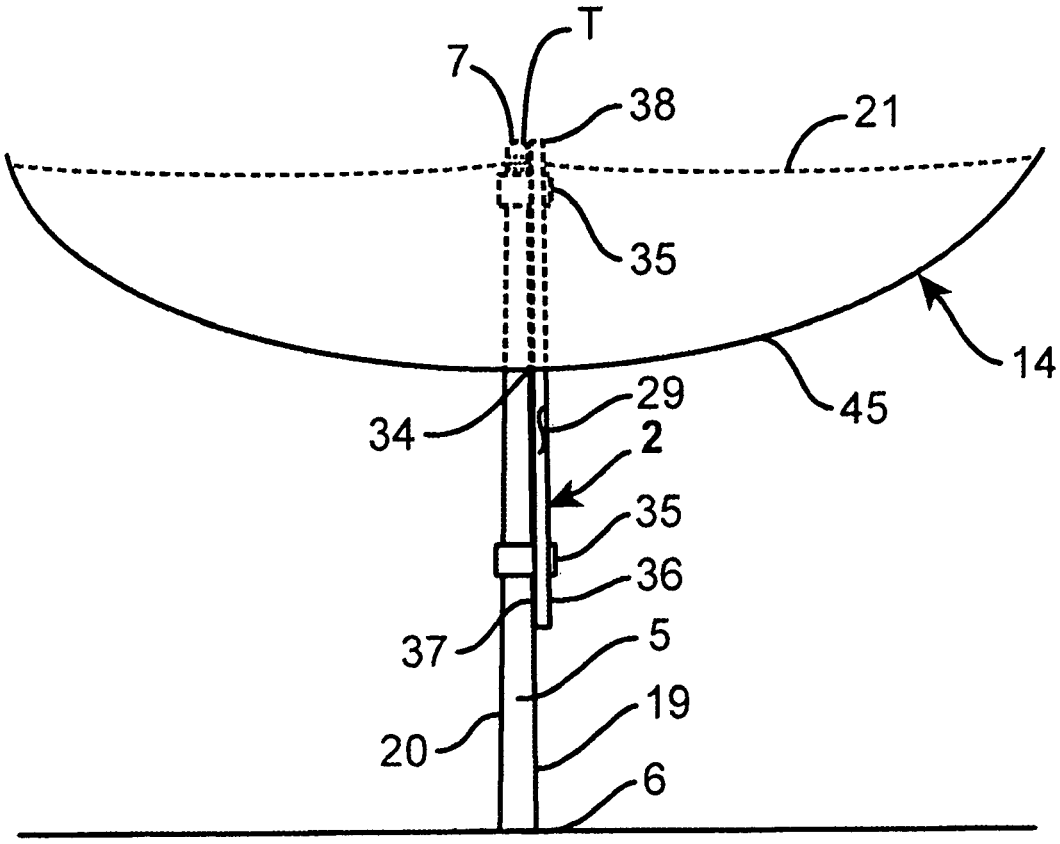
FIG. 13 is a side view of the present invention of FIG. 11, formed according to the present invention attached to a boat. The view is looking toward the center plane of the boat.
Figure 14:
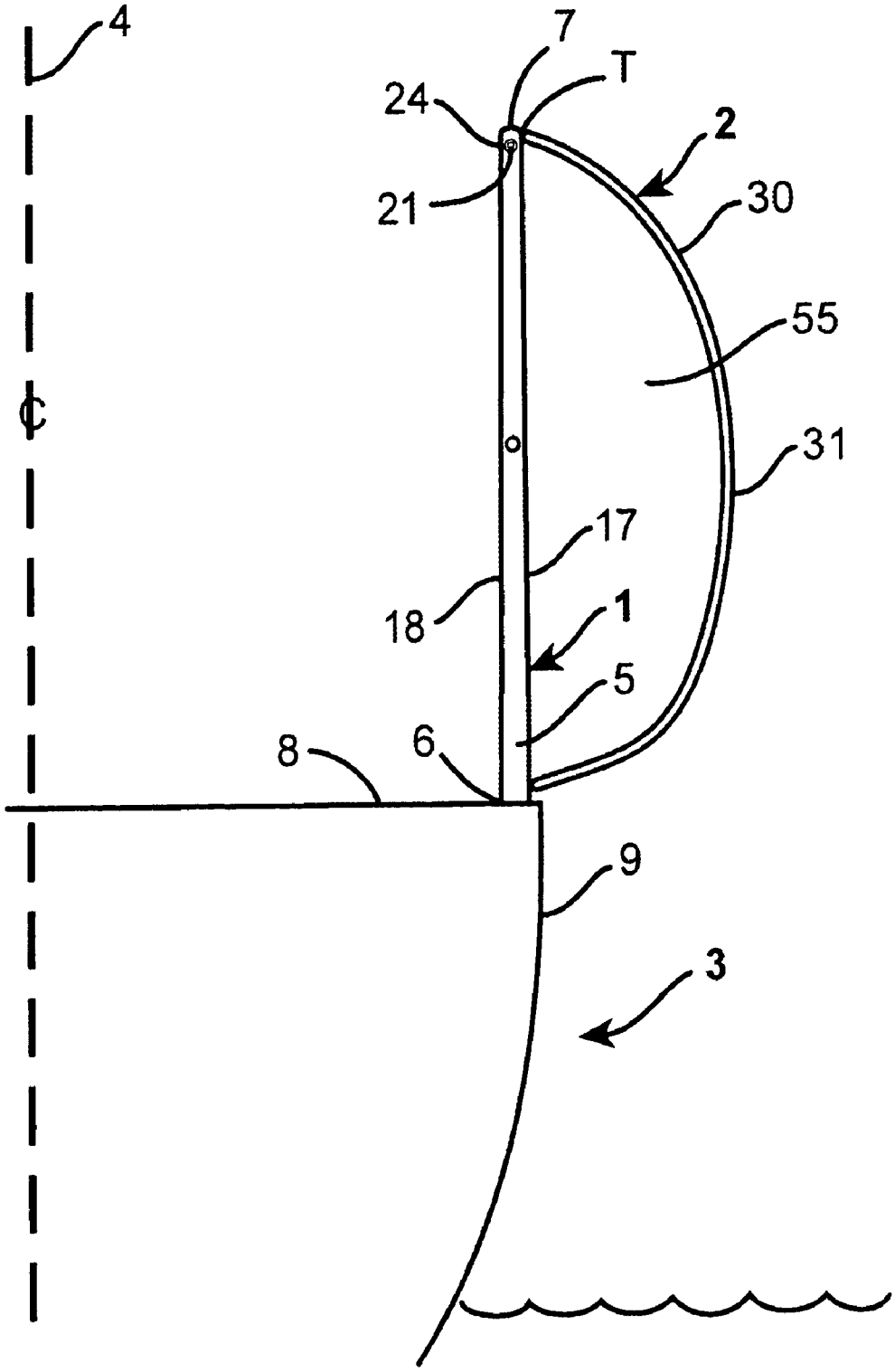
FIG. 14 is an end view of a stanchion having a structure formed according to the present invention attached thereto. The particular embodiment of the present invention has a circular shape.

As is shown in FIG. 11, in the present invention, the stanchion 1 also supports a generally vertically disposed slide 2. As shown in FIGS. 1 and 15, multiple stanchions 1, 101, 201 and 301 can be fitted with slides 2, 102, 202 and 302. The slide 2 has a lateral length. The lateral length runs generally vertically with respect to a typical straight, upstanding stanchion 1. As shown in FIG. 13, the slide 2 also has an outer slide surface 29 disposed away from the central plane 4 of the sail boat 3.

As shown in FIG. 11, the outer slide surface 29 has a profile 30. The profile 30 is an outer edge 31 of a generally vertical cross-section of the slide 2 that is also generally orthogonal to the central plane 4 of the sail boat 3.

As shown in FIG. 16, according to the present invention, the limit of the edge 31 of the profile 30 falls between a circular arc 32 and a curve 33.

The circular arc 32 that defines the inner limit of the profile edge 31 begins near the top 7 of the stanchion 1, has the maximum deflection point M of the lifeline 21 as its center, and travels away from the central plane 4 of the sail boat 3 and downwardly toward the deck 8 of the sail boat 3 so long as the arc 32 is disposed above a lateral limit 34 of the outer slide surface 29, the lateral limit 34 being a point with respect to the slide 2 below which the sail 14 cannot reach (see FIGS. 15 and 13).

As shown in FIG. 16, the curve 33 that defines the outer limit of the profile edge 31 begins near the top 7 of the stanchion 1 and moves progressively farther away from the maximum deflection point M of the lifeline 21 as it travels away from the top 7 of the stanchion 1, so long as the curve 33 is disposed above a lateral limit 34 of the outer slide surface 29, the lateral limit 34 being a point with respect to the slide 2 below which the sail 14 cannot reach.

As shown in FIGS. 11 and 12, in the preferred embodiment of the invention, the slide 2 is a separate piece that is affixed to the stanchion 1 by clamps 35 or tying the slide 2 to the stanchion 1 and can be easily removed from the stanchion 1 and replaced.

As shown in FIG. 7, in an alternate form of the invention, the slide 2 is a integral part of the stanchion 1 that cannot be separated from the stanchion 1.

As shown in FIG. 13, in the preferred embodiment of the invention, the outer surface 29 of the slide 2 has a pair of longitudinal limits 36 and 37 that create the longitudinal boundary of the outer slide surface 29. These limits 36 and 37 define the farthest extent of the outer slide surface 29 toward the bow 12 and stern 13 of the sail boat 3.

As is also shown in FIG. 13, in the preferred embodiment of the invention, the longitudinal limits 36 and 37 that create the longitudinal boundary of the outer slide surface 29 are relatively closely spaced throughout their entire lateral length, although the spacing of the longitudinal limits 36 and 37 can vary.

As shown in FIG. 11, in the preferred embodiment, the outer slide surface 29 has a highest lateral point 38 disposed near the top 7 of the stanchion 1, and the highest lateral point 38 on the outer slide surface 29 lies closer to the central plane 4 of the sail boat 3 than neighboring lower, lateral points on the adjacent portion 39 of the outer slide surface 29.

As shown in FIG. 16, in the preferred embodiment, the edge 31 of the profile 30 is a spiral 40 which begins near the top 7 of the stanchion 1, and moves progressively farther away from the maximum deflection point M of the lifeline 21 as it travels away from the top 7 of the stanchion 1, and the spiral 40 is defined as a locus of points beginning with a first point, the first point being near the top of the stanchion, and additional points on the spiral 40 being determined by the interior angle 41 between a radial ray 42 and a tangent ray 43, the radial ray 42 being drawn from a selected point on the spiral 40 and away from the maximum deflection point M of the lifeline 21, the radial ray 42 falling on a line defined by the selected point on the spiral and the maximum deflection point M of the lifeline 21, and the tangent ray 43 being drawn from the selected point on the spiral 40 and falling on a line tangent to the selected point, the tangent ray 43 traveling in a direction away from the central plane 4 of the sail boat 3, the interior angle 41 being greater than zero degrees and less than or equal to ninety degrees.

In the preferred embodiment, the interior angle falls approximately in the range between 55 and 80 degrees, and is most preferably approximately 65 degrees.

As described above, the profile 30 or shape of the outer surface 29 of the slide 2 is preferably defined by a spiral 40 according to selected parameters.

As also described above the present invention is used to prevent the head sail or jib 14 from being caught on the stanchion 1 for the lifeline 21.

Figure 6:
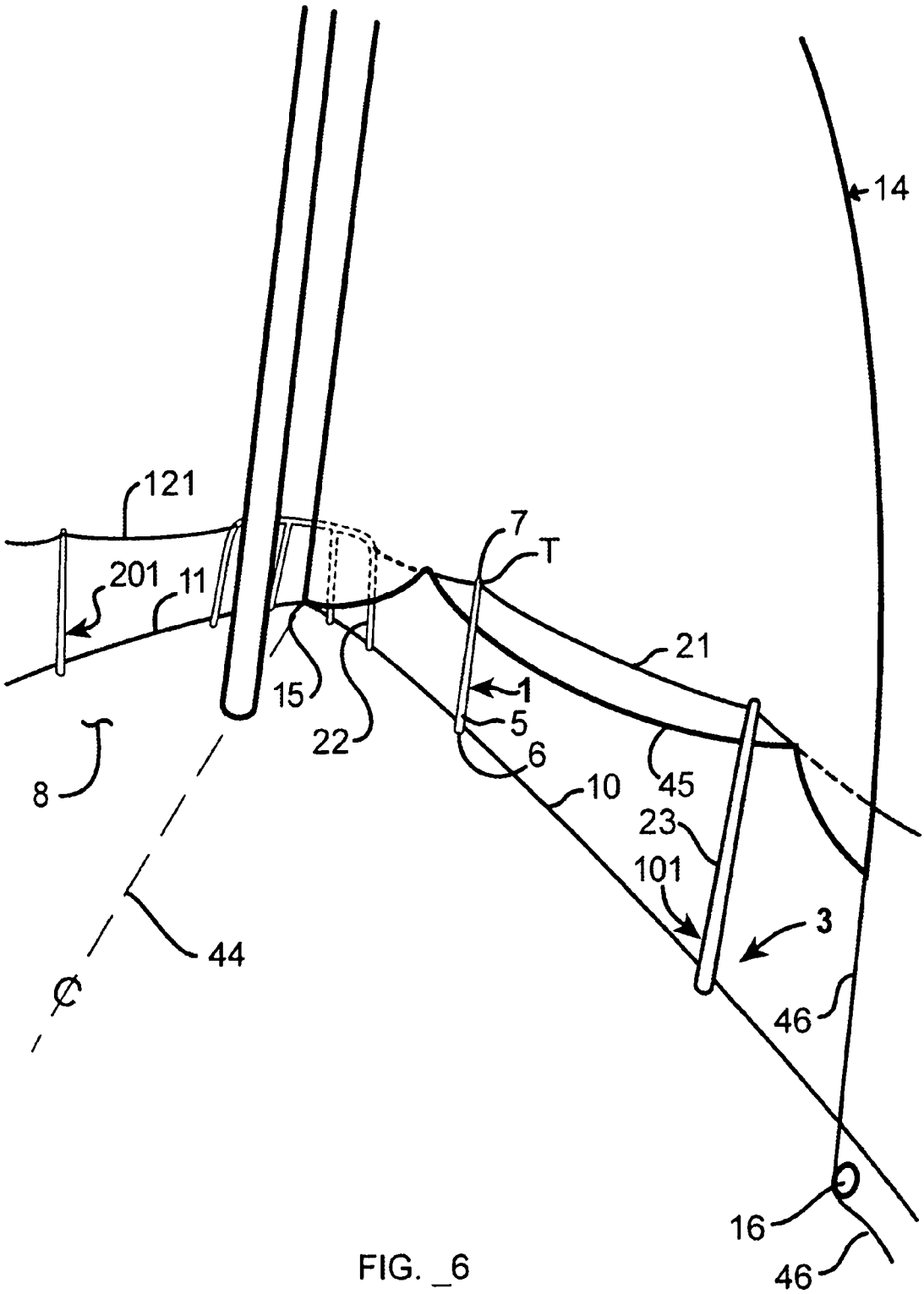
FIG. 6 is a simplified perspective view of a sail boat showing the bow of the boat, taken from the cockpit in the stern of the boat. This view shows the simplified rigging for the lower portion of a head sail or jib. The stanchions shown do not have the present invention attached to them. The jib is shown as it would look if it had been blown outside of the lifelines and then trimmed to a point where it was caught on two of the stanchions of the boat.

As is shown in FIG. 6, it is possible for enough of the head sail 14 to be blown outside of the lifeline 21 that, during the trimming of the sail 14, the sail 14 can be caught on the first stanchion 1 and a second stanchion 101. However, the inventor has found that if a determination is made for the size and shape of the slide 2 for each stanchion 1 or 101 forward of the jib-block 16 on which the sail 14 could be caught, as if the sail 14 were only ever to be caught on that stanchion 1 of 101, then each stanchion 1 or 101 will be fitted with the slide that is also the appropriate shape when the sail 14 is blown outside of the lifeline 21 and caught on more than just the first stanchion 1.

The size and shape of the present invention is determined by a number of factors, including the sag in the top lifeline 21 of the sail boat 3 and the geometrical relationship of the top 7 of the stanchion 1 to the lower rigging points of the head sail 14. The points of trim for the head sail 14 are the jib-tack fitting 15 and the jib block or jib car 16.

The jib-tack fitting 15, the approximate top point T of the stanchion 1 on which the sail can be caught and jib block 16 are all shown in FIG. 2.

The centerline 44 of the boat 3 at the top of the deck 8 is also shown in FIG. 2. The centerline 44 of the boat 3 at the top of the deck 8 lies in the central plane 4 of the boat 3. The center-plane 4 of the boat 3 is a plane that divides the hull 9 of the boat 3 into two halves running from the bow 12 to the stern 13. Most sail boats 3 are symmetric or nearly symmetric with respect to their central planes 4. For purposes of the description here, the centerline 44 of the boat 3 will be taken as a line that transects the center plane 4 and runs along the deck 8.

The preferred shape of the outer slide surface 29 of the present invention will be generally the same for all boats 3. However, the slide 2 will be larger where there is more sag in the lifeline 21 and where the stanchion 1 is relatively tall.

Where the lifeline 21 is taut and less able to be deformed by the weight and forces of the jib 14 pressing on it when the jib 14 is being trimmed outside of the lifeline 21, the slide 2 will be relatively small.

Where the lifeline 21 is loose and more able to be deformed by the weight and forces of the jib 14 pressing on it when the jib 14 is being trimmed outside of the lifeline 21, the slide 2 will be relatively large.

As is shown in FIG. 2, it is common that the stanchions 1 and 101 are not in-line with each other due to the outer edges 10 and 11 of the deck 8 being curved.

The size and shape of the slide 2 is also dependent on the height and positions of the stanchion 1 with respect to the jib-tack fitting 15 and the jib block or jib car 16.

Typically, the slide 2 will be larger with a boat 3 fitted with a tall stanchion 1. A stanchion 1 whose top 7 is relatively high above the jib-tack fitting 15 and the jib block 16.

The proper size and shape of the slide 2 for a particular stanchion 1 is preferably determined as follows.

As shown in FIG. 16, first the trim angle P of the selected stanchion 1 is determined. The trim angle P of the stanchion 1 is defined in reference to a plane A (see FIG. 2) defined by the jib-tack fitting at the bow 15, the jib block or jib-car 16 and the point T at or near the top 7 of the stanchion 1 where the sail 14 could be caught, assuming the stanchion 1 was not fitted with the slide 2 of the present invention.

Figure 3:
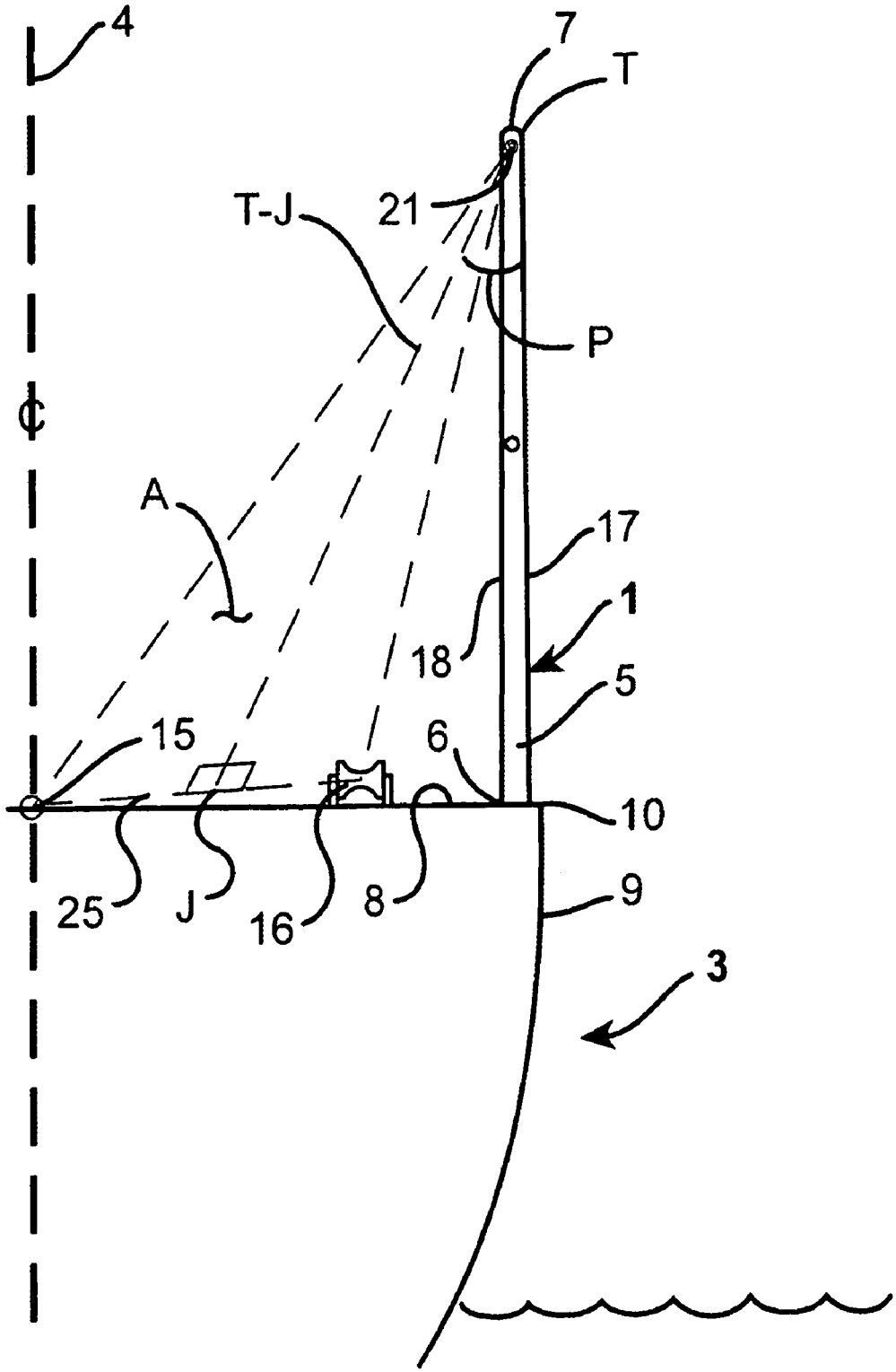
FIG. 3 is an end cross-sectional view of the boat and a stanchion attached to the deck of a boat from the rear of the boat. A typical upstanding, straight stanchion is shown.

This plane is labeled Q in FIGS. 2 and 3. FIG. 2 best shows the three points that defined plane Q: the jib-tack fitting 15 at the bow 12, the jib block 16 that is closer to the stern 13 and the point T at or near the top 7 of the stanchion 1 where the sail 14 could be caught.

In FIG. 3, which is an end view of a stanchion 1, a transect of this plane A is shown as line T-J. As shown in FIG. 2, the transect T-J is a line that intersects with the point T on the stanchion 1 where the sail 14 could be caught and with a point J on the jib trim line 25 defined by the jib-tack fitting 15 and the jib block 16, and the line T-J meets the jib trim line 25 at approximately a right angle.

For purposes of defining line segment T-J, the orientation of the line segment T-J to the jib trim line 25 does not have to be exactly at right angles. The general orientation of line segment T-J can be approximated.

In practice, this measurement can be made rather simply with a ruler and a protractor, when the boat 3 is docked and sitting level in the water.

Figure 5:
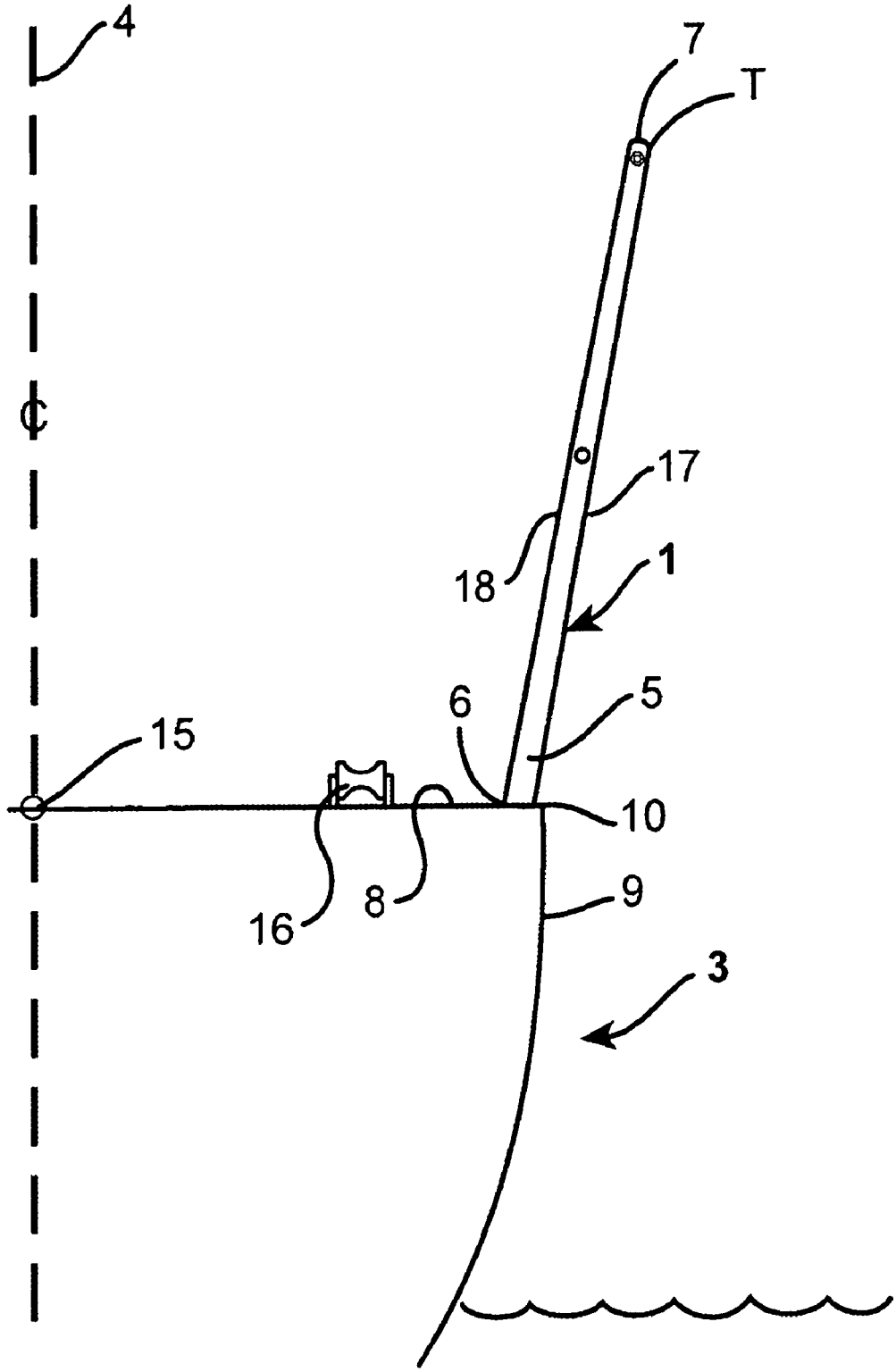
FIG. 5 is an end cross-sectional view of a boat and a stanchion attached to the deck of a boat from the rear of the boat. The stanchion shown is bent outwardly away from the centerline of the boat.

The user situates himself outside of the lifeline 21, looking towards the bow 12. The base line of the protractor is then oriented vertically with the origin point for the protractor at point T on the stanchion 1. Then, the user sweeps the ruler around the origin point of the protractor until the edge of the ruler roughly points to the jib-trim 25 line between the jib-tack fitting 15 and the jib block or jib car 16. The edge of the ruler should then be sitting on line T-J. See FIGS. 3, 4 and 5. The angle P between the base line of the protractor and the edge of the ruler can be measured for creating a template for making the present invention.

Second, the point of maximum deflection M of the lifeline 21 on line T-J at the selected stanchion 1 is determined. This distance will be measured with respect to line segment T-J. The maximum deflection M of the top lifeline 21 around the stanchion 1 is determined by pulling or pushing the lifeline 21 inward toward the centerline 44 of the boat 3 on either side of the stanchion 1, in the same manner that the foot 45 of the sale 14 in combination with the sheet 46 for the sail 14 pulls the lifeline 21 in towards the center-plane 4 of the boat 3, when the foot 45 of the sail 14 is caught on the stanchion 1 when trimming the sail 14 (see FIG. 2). Note a second sheet 146 for the sail 14 is not shown in FIG. 2. This sheet 146 is shown in FIG. 1 and is used when the sail is on the port side of the sail boat 3.

The inventor has determined that the following is the best method for approximating the forces the jib or sail 14 exerts on the lifeline 21 when it is being trimmed from a place outside of a selected stanchion 1.

For this measurement, the user needs to set a ruler on line T-J with the zero mark on the ruler set at the point T of the stanchion 1 where the sail 14 is expected to be caught. Preferably, the user has an assistant who can hold the ruler at the proper stanchion trim angle P and the edge of the ruler pointing to point J on jib trim line 25.

As shown in FIG. 16, for this measurement, the user also needs a piece of rope 47, twine or similar device that is approximately 7 feet long.

The rope is preferably the approximate average of the distances of the selected stanchion 1 from its neighboring stanchions or other members 22 and 23 holding the lifeline 21. For purposes of accomplishing this measurement with simple tools, the rope 47 can be slightly less than the average of the distances of the selected stanchion 1 from the neighboring stanchions or other members 22 and 23.

The user takes the piece of rope 47 and sits on the deck 8 facing the stanchion 1. Holding the ends of the string 47 in either hand, the user grasps the top lifeline 21 with both hands and slides his hands along the top lifeline 21 away from the stanchion 1 until string is held taut. The string 47 should extend from the first point 26 on the lifeline 21, which is approximately midway between the bow side member 22 and the stanchion 1, to the second point 27 on the lifeline 21 which is approximately midway between the stern side member 23 and the stanchion 1. The string 47 must lie between the user and the stanchion 1. Continuing to hold the string 47 taut, the user pulls down and inboard on the lifeline 21 to simulate what happens when the jib 14 is normally being trimmed and portions of the jib 14 are resting on and disposed outside of the lifeline 21 and could be caught on the particular stanchion 1. Approximately 10 pounds of force with each hand is about right. This is approximately the limit of the stretch at the lifeline 21. If, in the course of pulling on the lifeline 21, the string 47 becomes slack, the string 47 should be gathered until it is taut again.

Where the string 47 passes the stanchion 1 and intersects with the edge of the ruler lying along line segment T-J, the maximum deflection point M from the point T on the stanchion 1 is measured (see FIG. 2). This point M on line T-J is the maximum deflection M of the lifeline 21 on line T-J.

With these measurements taken, the proper size and shape of the slide 2 present invention can now be determined.

As stated earlier, the profile 30 of the outer surface 29 of the slide 2 is preferably defined by a spiral 40.

Knowing the location of line T-J, and the point of maximum deflection M of the lifeline on line T-J, the shape of the spiral 40 can be determined.

As shown in FIG. 16, preferably, the spiral 40 will start at the point T on the stanchion 1 where the sail 14 can be caught and the spiral 40 will continue until it arcs back to the stanchion 1 or to a point near the stanchion 1.

Generally, stanchions 1 are formed as straight tubes or posts 5 that stand generally vertically from the deck 8 of the boat 3 when the boat 3 sits level in the water. Stanchions 1 formed as straight tubes or posts 5 derive significant benefit from the present invention.

But if the stanchion 1 is bent or curved, preferably the spiral 40 that defines the profile 30 of the outer slide surface 29 will lie in a plane defined as the vertical projection of line T-J.

The preferred method for forming a slide 2 according to the present invention for an individual sailor using only hand tools and simple measuring devices such as protractor and ruler is to create a life-sized template for the slide 2, create a rough spiral 50 for the profile 30, and then using the template to cut a slide 2 from suitable material, and then sand the slide 2 so there are no sharp edges or corners (see FIG. 16).

This description assumes the slide 2 will be attached to an existing stanchion 1. The fabricator first draws a full-sized, cross-section of the upper portion of the stanchion 1. A line 51 is then drawn through the point T on the stanchion 1 where the sail 14 could be caught that would represent a vertical line 51 through the stanchion 1 when the boat 3 is in the water and level. Using this line 51, a ray is drawn downwardly from the point T on the stanchion 1 that is set at the stanchion trim angle P to the vertical line 51 and drawn toward what would be the center-plane 4 of the boat 3. This is line T-J and the location of the maximum deflection point M is then determined.

The fabricator can easily make a rough spiral 50 for the profile 30 of the outer slide surface 29, according to the following method. Using line T-J and point T of the selected stanchion as the beginning of the rough spiral 50 of the outer face 29 of the slide 2, a first peripheral ray TA is drawn from the point T of the stanchion in a direction that would be away from the center-plane of the boat and what would be downwardly from line T-J. This first peripheral ray TA is set at a selected angle 52 to line T-J and lies generally in a plane defined by line T-J and the points directly above and below line T-J. The selected angle 52 is specifically defined as the interior angle between first peripheral ray TA and a base ray 53 lying along line T-J, both rays projecting away from what would be the centerline 44 of the boat 3 and both sharing as their origin the point T on the stanchion 1.

The inventor has found that the preferred selected angle 52 between first ray TA and the base ray 53 is 70 degrees. An angle of 70 degrees will accommodate most types of sail cloth and materials for the outer surface 29 of the slide 2; however, other angles are possible and may be preferred given the friction characteristics of the outer slide surface 29 and the material of the sail 14.

Once the first peripheral ray TA is drawn, a first radial MA ray is drawn from the maximum deflection point of the lifeline M on line T-J away from the center-plane 4 of the boat 3 that is set at a 10 degree angle to line T-J and lies in the plane defined by line T-J and first peripheral ray TA. This is radial ray MA. Where rays TA and MA intersect, a point A on the rough spiral 50 is set that will define the profile 30 of the slide surface 29.

The next point defining the rough spiral 50 for the profile 30 of the slide surface 29 is determined in a similar fashion.

A second peripheral ray AB is drawn from point A away from the center-plane 4 of the boat 3 that is set at 70 degrees to first radial ray MA and lies in the plane defined by line segment T-J and first radial ray MA.

A second radial ray MB is drawn from the maximum deflection point of the lifeline M on line segment T-J away from the center-plane 4 of the boat 3 that is set at 20 degrees to line segment T-J or 10 degrees from first radial ray MA and lies in the plane defined by line segment T-J and line TA. Where rays AB and MB meet, another point B on the spiral that defines the profile 30 of the slide surface 29 is determined.

The steps of determining the intersection of successive peripheral and radial rays is continued until the points on the spiral intersect with the stanchion 1 or would sweep past the stanchion 1, depending on the shape of the stanchion 1. Each new peripheral ray is 70 degrees from the radial ray that intersects with its origin, and the radial rays are set 10 degrees from each other.

In this rough spiral 50, each new peripheral ray is preferably 70 degrees from the radial ray that intersects with its origin, but this selected angle 52 can vary considerably with angle measurements between 60 and 80 degrees being well accepted variations for the preferred method of forming a rough spiral 50 using simple tools.

The radial rays can also be set at a range of angle measurements from each other, but the inventor has found that determining points for the spiral at every 10 degrees is preferred when using simple tools, but this angle can vary considerably with angles between 5 and 20 degrees being well accepted variations for the preferred method of forming the rough spiral 50 using simple tools.

Connecting points A, B, C, . . . by a curve that represents an approximately continuously curving face creates the preferred profile 30 of the outer surface 29 of the slide 2, made using simple tools.

The preferred spiral 40 or rough spiral 50 for the profile 30 for the slide surface 29 creates a surface 29 where the forces pulling the sail 14 into contact with the slide surface 29 never create enough friction to actually have the sail 14 become caught on the present invention itself, as long as the slide surface 29 is not too wide.

Frictional forces between the sail 14 and the slide 2 are also reduced in a number of other ways.

Preferably the slide surface 29 of the present invention is not formed with a large wide face (see FIG. 12). Preferably the outer slide surface 29 of the invention that will rub against the sail 14 is formed with a material that has a low friction coefficient and is as smooth as possible. A practical solution for certain materials is to apply teflon tape to the outer slide surface 29 to reduce friction.

If there were no frictional forces at work, the present invention would not need to be made as a spiral 40 or rough spiral 50, but could be made as a simple circular arc 32 with its center at the maximum deflection point M on line T-J and the radius of the arc 32 being defined as the distance between the maximum deflection point M and the point T on the stanchion 1 where the sail 14 can be caught (see FIG. 16).

Having determined the profile 30 of the outer slide surface 29 of the slide invention, the surface 29 needs to have a certain width or depth to prevent tearing the head sail 14 itself. The inventor has found that an approximately ¼ inch to ½ inch wide surface 29 works well.

The outer surface 29 of the slide 2 should not cover a longitudinal 180 degree arc from the vertical axis 54 of the stanchion 1 as this will create a large surface area for the outer surface 29 of the slide 2 which will increase frictional forces that can hold the sail 14.

As is shown in FIG. 13, the present invention can also be made by welding a suitably wide metal tube or rod to the standard stanchion 1, with the outer portion 229 of the metal tube or rod conforming to the rough spiral 250 of the present invention.

As is shown in FIG. 12*a*, the present invention can also be made by attaching to the stanchion 1 a suitable structure made from metal, plastic, composite, wood or other material that provides the desired shape. If the structure of the present invention cannot be welded or adhered to the stanchion it can be bolted, fastened, riveted or bound thereto by ties such as hose clamps 35. Hose clamps 35 are a preferred simple solution. The hose clamps are preferably wrapped with tape to protect the sail 14 from any sharp edges.

The preferred structure made according to the present invention will be strong enough to not be significantly deformed or distorted by the jib 14 when the jib 14 is caught outside the lifeline 21.

The preferred structure will also be lightweight. Lighter boats are generally faster than heavier boats. The preferred structure of the present invention will not increase the weight of a typical stanchion 1 appreciably.

The preferred structure will also not create wind drag or wind resistance. Therefore, the preferred structure has openings 55 between the outer surface 29 and the stanchion 1 to prevent wind drag. These openings 55 also provide additional sight lines.

Figure 9:
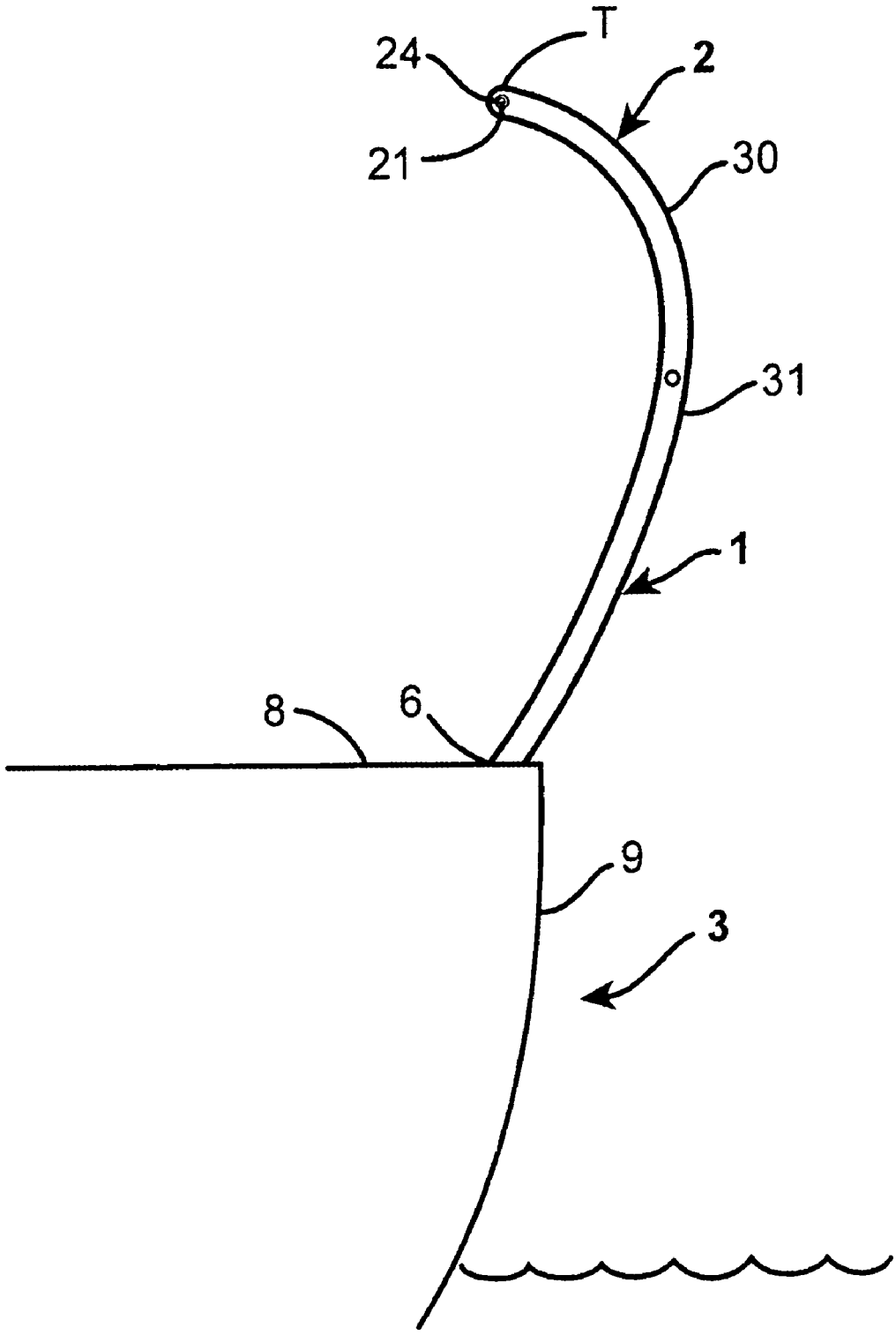
FIG. 9 is an end view of a stanchion formed according to the present invention attached to a boat.
Figure 10:
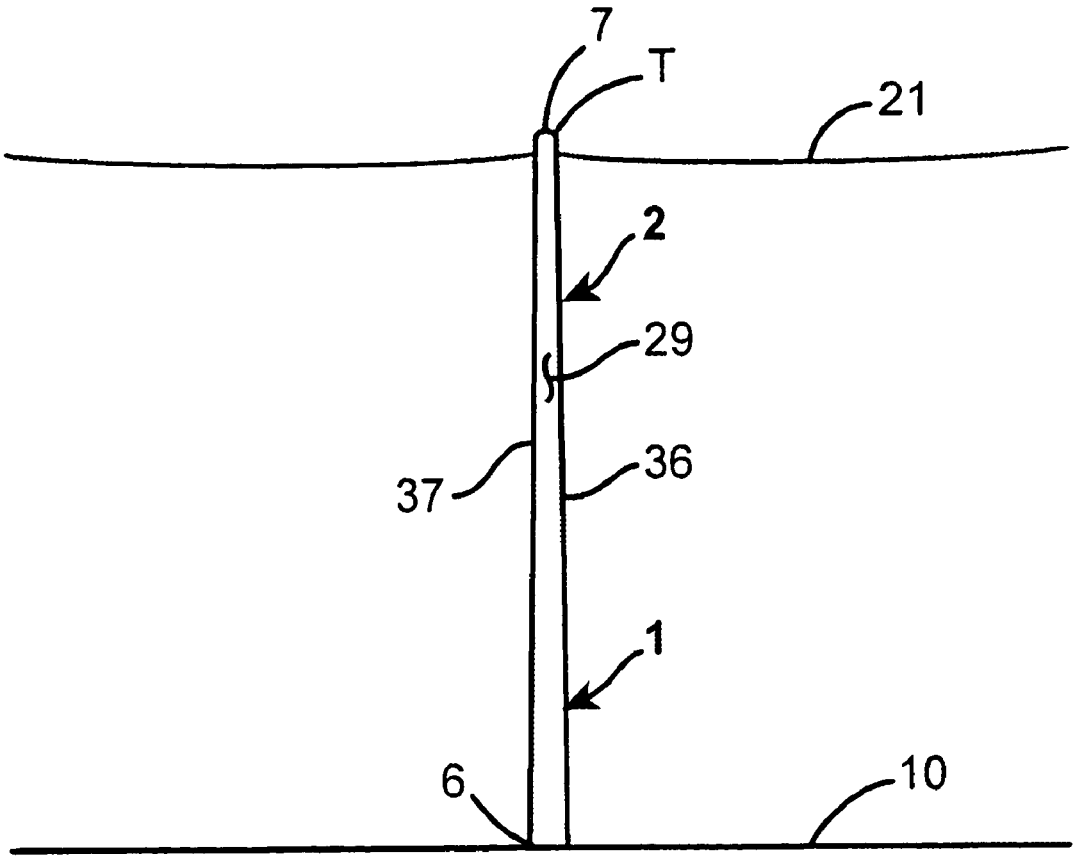
FIG. 10 is a side view of the stanchion of FIG. 9, formed according to the present invention attached to a boat.

In one preferred embodiment of the present invention, as shown in FIG. 9, the slide 2 with its outer slide surface 29 for preventing the jib 14 from catching on the stanchion 1 is an integral part of the stanchion 1 and is made from a lightweight but strong material such as titanium. However most users will find titanium to be cost prohibitive. Where cost is a significant factor stainless steel is an acceptable material.

Because of the typical placement of most stanchions 1, 101, 201 and 301, the present invention will protrude outwardly from the hull 9. This will expose the present invention to being struck by objects that are too close to the boat, such as other craft, buoys or objects on a dock. Because the stanchions 1 and 101 and 201 and 301 are connected to each other by the lifelines 21 and 121, respectively, if one of the stanchions 1, 101, 201 or 301 were to fail or be broken it could effect the other stanchions 1, 101, 201 or 301 and lifelines 21 of 121 of the boat 3, which could significantly impair the user's ability to sail the boat 3.

Thus, in a preferred embodiment of the invention, it is preferable that the connection of the slide 2 to the upstanding portion of the stanchion 1 be created with fail safe or weakened connections that are designed to give way and break rather than have the upstanding stanchion 1 break, if the slide 2 is struck sufficiently hard by an external object other than the jib 14. As shown in FIG. 1, one such embodiment entails forming a slide 2 made from plastic that can be attached to the stanchion 1 by means of hose clamps 35. If the slide 2 of the present invention is struck by an external object such as another boat, the slide 2 will either itself break without harming the stanchion 1 or break free from the stanchion 1 at the clamps 35.

FIG. 11 is an end view of a stanchion 1 having a slide 2 attached thereto. The slide 2 is preferably made from ¼" to ⅜" thick, UV stable polyethylene and is formed with a rough spiral 50. A suitable polyethylene is commercially sold by plastics retailers under the name "Seaboard".

Having the top lifeline 21 thread through the slide 2 helps the slide 2 maintain its orientation.

A rough test of the profile 30 of the slide 2 can be conducted without sailing. Attach a string to the jib-tack fitting 15. Pass the string through the jib-car or jib block 16 and drape the string over the top of the lifeline 21 around the stanchion 1 having slide 2. Now pull the string through the jib car 16. The string should rise and drop onto the deck 8 without getting caught.

FIG. 7 is an end view of a stanchion 1 formed according to the present invention attached to a boat 3. The stanchion formed according to the present invention is made by welding steel tubing.

I claim:

1. A stanchion attached to a sail boat, the stanchion comprising:

a. a generally vertically disposed post, having a base and a top, the base of the stanchion being attached to a sail boat, the sail boat having a deck and a hull, the deck and the hull meeting at the outer edges of the deck, and the stanchion being disposed near an outer edge of the deck, the sail boat also having a bow and a stern and a central plane that runs from the bow to the stern, the sail boat also having at least one sail having points of trim at a jib-tack fitting near the bow of the sail boat and a jib block disposed away from the bow of the boat and towards the stern of the boat, the post also having an outer surface disposed away from the central plane of the sail boat, and an inner surface disposed towards the central plane of the sail boat and a bow side limit and a stern side limit, wherein the stanchion is on the same side of the central plane of the sail boat as the jib block, and the jib block is closer to the stern of the sail boat than the stanchion, and wherein the stanchion supports a lifeline near the top of the stanchion, and the lifeline runs generally along the outer edge of the deck to which the stanchion is connected, and the lifeline is supported by a bow side member away from the bow side limit of the stanchion, and the lifeline is also supported by a stern side member away from the stern side limit of the stanchion, and the connection of the lifeline to the stanchion can be characterized in part by a maximum deflection point of the lifeline, the maximum deflection point of the lifeline describing the amount of displacement that can be imposed on the lifeline by displacing the lifeline with respect to a line segment that goes from approximately the top of the stanchion to approximately an intersection point on a jib trim line, the jib trim line being a line running from the jib-tack fitting to the jib block, that intersection point being where the line segment meets the jib trim line at a right angle, the displacement of the lifeline occurring at first and second points on the lifeline, the first point on the lifeline being approximately midway between the bow side member and the stanchion and the second point on the lifeline being approximately midway between the stern side member and the stanchion towards the cental plane of the boat, the displacement occurring by forcing the lifeline at the first and second points on the lifeline in the direction of the line segment and toward the central plane of the sail boat until the stanchion is close to deforming under the force and determining where a line drawn from the first and second points on the lifeline would intersect with the line segment;

b. a generally vertically disposed slide supported by the stanchion having a lateral length and an outer slide surface disposed away from the central plane of the sail boat;

c. the outer slide surface having a profile, the profile being an outer edge of a generally vertical cross-section of the slide that is also generally orthogonal to the central plane of the sail boat, and the limit of the edge of the profile falls between a circular arc which begins near the top of the stanchion, has the maximum deflection point of the lifeline as its center, and travels away from the central plane of the sail boat and downwardly toward the deck of the sail boat so long as the arc is disposed above a lateral limit of the outer slide surface, the lateral limit being a point with respect to the slide below which the sail cannot reach, and a curve which begins near the top of the stanchion and moves progressively farther away from the maximum deflection point of the lifeline as it travels away from the top of the stanchion so long as the curve is disposed above a lateral limit of the outer slide surface, the lateral limit being a point with respect to the slide below which the sail cannot reach.

2. The stanchion of claim 1, wherein:

the slide is a separate piece that is affixed to the stanchion and can be removed from the stanchion.

3. The stanchion of claim 1, wherein:

the slide is a integral part of the stanchion.

4. The stanchion of claim 1, wherein:

the outer surface of the slide has a pair of longitudinal limits that create the longitudinal boundary of the outer slide surface.

5. The stanchion of claim 4, wherein:

the longitudinal limits that create the longitudinal boundary of the outer slide surface are relatively closely spaced.

6. The stanchion of claim 1, wherein:

the outer slide surface has a highest lateral point disposed near the top of the stanchion, and wherein the highest lateral point on the outer slide surface lies closer to the central plane of the sail boat than neighboring lower, lateral points on the outer slide surface.

7. The stanchion of claim 1, wherein the edge of the profile is a spiral which begins near the top of the stanchion, and moves progressively farther away from the maximum deflection point of the lifeline as it travels away from the top of the stanchion, and the spiral is defined as a locus of points beginning with a first point, the first point being near the top of the stanchion, and additional points on the spiral being determined by the interior angle between a radial ray and a tangent ray, the radial ray being drawn from a selected point on the spiral and away from the maximum deflection point of the lifeline, the radial ray falling on a line defined by the selected point on the spiral and the maximum deflection point of the lifeline, and the tangent ray being drawn from the selected point on the spiral and falling on a line tangent to the selected point, the tangent ray traveling in a direction away from the central plane of the sail boat, said spiral angle being greater than zero degrees and less than or equal to ninety degrees.

8. The stanchion of claim 7, wherein:

the slide is a separate piece that is affixed to the stanchion and can be removed from the stanchion.

9. The stanchion of claim 7, wherein:

the slide is a integral part of the stanchion.

10. The stanchion of claim 7, wherein:

the outer surface of the slide has a pair of longitudinal limits that create the longitudinal boundary of the outer slide surface.

11. The stanchion of claim 10, wherein:

the longitudinal limits that create the longitudinal boundary of the outer slide surface are relatively closely spaced.

12. A stanchion attached to a sail boat, the stanchion comprising:

a. a generally vertically disposed post, having a base and a top, the base of the stanchion being attached to a sail boat, the sail boat having a deck and a hull, the deck and the hull meeting at the outer edges of the deck, and the stanchion being disposed near an outer edge of the deck, the sail boat also having a bow and a stern and a central plane that runs from the bow to the stern, the sail boat also having at least one sail having points of trim at a jib-tack fitting near the bow of the sail boat and a jib block disposed away from the bow of the boat and towards the stern of the boat, the post also having an outer surface disposed away from the central plane of the sail boat, and an inner surface disposed towards the central plane of the sail boat and a bow side limit and a stern side limit, wherein the stanchion is on the same side of the central plane of the sail boat as the jib block, and the jib block is closer to the stern of the sail boat than the stanchion, and wherein the stanchion supports a lifeline near the top of the stanchion, and the lifeline runs generally along the outer edge of the deck to which the stanchion is connected, and the lifeline is supported by a bow side member away from the bow side limit of the stanchion, and the lifeline is also supported by a stern side member away from the stern side limit of the stanchion, and the connection of the lifeline to the stanchion can be characterized in part by a maximum deflection point of the lifeline, the maximum deflection point of the lifeline describing the amount of displacement that can be imposed on the lifeline by displacing the lifeline with respect to a line segment that goes from approximately the top of the stanchion to approximately an intersection point on a jib trim line, the jib trim line being a line running from the jib-tack fitting to the jib block, that intersection point being where the line segment meets the jib trim line at a right angle, the displacement of the lifeline occurring at first and second points on the lifeline, the first point on the lifeline being approximately midway between the bow side standing member and the stanchion and the second point on the lifeline being approximately midway between the stern side upstanding member and the stanchion towards the cental plane of the boat, the displacement occurring by forcing the lifeline at the first and second points in the direction of the line segment and toward the central plane of the sail boat until the stanchion is close to deforming under the force and determining where a line drawn from the first and second points on the lifeline would intersect with the line segment;

b. a generally vertically disposed slide supported by the stanchion having a lateral length and an outer slide surface disposed away from the central plane of the sail boat;

c. the outer slide surface having a profile, the profile being an outer edge of a generally vertical cross-section of the slide that is also generally orthogonal to the central plane of the sail boat, and the limit of the edge of the profile falls between a circular arc which begins near the top of the stanchion, has the maximum deflection point of the lifeline as its center, and travels away from the central plane of the sail boat and downwardly toward the deck of the sail boat until it reaches a point that is approximately above the edge of the deck and directly below the lifeline, and a curve which begins near the top of the stanchion, and moves progressively farther away from the maximum deflection point of the lifeline as it travels away from the top of the stanchion.

13. The stanchion of claim 12, wherein:

the slide is a separate piece that is affixed to the stanchion and can be removed from the stanchion.

14. The stanchion of claim 12, wherein:

the slide is a integral part of the stanchion.

15. The stanchion of claim 12, wherein:

the outer surface of the slide has a pair of longitudinal limits that create the longitudinal boundary of the outer slide surface.

16. The stanchion of claim 15, wherein:

the longitudinal limits that create the longitudinal boundary of the outer slide surface are relatively closely spaced.

17. The stanchion of claim 12, wherein:

the outer slide surface has a highest lateral point disposed near the top of the stanchion, and wherein the highest lateral point on the outer slide surface lies closer to the central plane of the sail boat than neighboring lower, lateral points on the outer slide surface.

18. The stanchion of claim 12, wherein the edge of the profile is a spiral which begins near the top of the stanchion, and moves progressively farther away from the maximum deflection point of the lifeline as it travels away from the top of the stanchion so long as the profile is disposed above a lateral limit of the outer slide surface, the lateral limit being a point with respect to the slide below which the sail cannot reach, and the spiral is defined as a locus of points beginning with a first point, the first point being near the top of the stanchion, and additional points on the spiral being determined by the interior angle between a radial ray and a tangent ray, the radial ray being drawn from a selected point on the spiral and away from the maximum deflection point of the lifeline, the radial ray falling on a line defined by the selected point on the spiral and the maximum deflection point of the lifeline, and the tangent ray being drawn from the selected point on the spiral and falling on a line tangent to the selected point, the tangent ray traveling in a direction away from the central plane of the sail boat, said spiral angle being greater than zero degrees and less than or equal to ninety degrees.

19. The stanchion of claim 18, wherein:

the slide is a separate piece that is affixed to the stanchion and can be removed from the stanchion.

20. The stanchion of claim 19, wherein:

the outer surface of the slide has a pair of longitudinal limits that create the longitudinal boundary of the outer slide surface, and the longitudinal limits that create the longitudinal boundary of the outer slide surface are relatively closely spaced.

* * * * *